US008084178B2

(12) United States Patent
Tosaka et al.

(10) Patent No.: US 8,084,178 B2
(45) Date of Patent: Dec. 27, 2011

(54) NON-MAGNETIC TONER

(75) Inventors: Emi Tosaka, Suntoh-gun (JP); Koji Abe, Numazu (JP); Yushi Mikuriya, Mishima (JP); Satoshi Handa, Suntoh-gun (JP); Shinya Yachi, Mishima (JP); Kazumi Yoshizaki, Suntoh-gun (JP); Yasuhiro Hashimoto, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 586 days.

(21) Appl. No.: 11/917,803

(22) PCT Filed: Jun. 28, 2006

(86) PCT No.: PCT/JP2006/313351

§ 371 (c)(1),
(2), (4) Date: Dec. 17, 2007

(87) PCT Pub. No.: WO2007/077643

PCT Pub. Date: Jul. 12, 2007

(65) Prior Publication Data

US 2009/0087768 A1 Apr. 2, 2009

(30) Foreign Application Priority Data

Jan. 6, 2006 (JP) ..... 2006-001074
Mar. 7, 2006 (JP) ..... 2006-060682

(51) Int. Cl.
*G03G 9/087* (2006.01)

(52) U.S. Cl. ..... 430/108.4; 430/109.3; 430/108.8; 430/111.4; 430/123.53

(58) Field of Classification Search ..... 430/111.4, 430/109.3, 123.53, 108.8, 108.4
See application file for complete search history.

(56) References Cited

U.S. PATENT DOCUMENTS 4,990,424 A 2/1991 Van Dusen et al. ..... 430/106.6
5,180,649 A * 1/1993 Kukimoto et al. ..... 430/108.23
5,547,800 A 8/1996 Nishimori et al. ..... 430/110

(Continued)

FOREIGN PATENT DOCUMENTS

EP 0592018 A2 7/1990

(Continued)

OTHER PUBLICATIONS

Borsenberger, Paul M. et al. Organic Photoreceptors for Imaging Systems. New York: Marcell-Dekker, Inc. pp. 6-17.*

(Continued)

*Primary Examiner* — Christopher Rodee
(74) *Attorney, Agent, or Firm* — Fitzpatrick, Cella, Harper & Scinto

(57) ABSTRACT

A non magnetic toner comprises toner particles each containing at least a binder resin, a colorant and a wax component. The toner further comprises an inorganic fine powder. A storage elastic modulus at 110° C. ($G'_{110}$) of the non magnetic toner is in a range of $2.00\times10^4$ to $2.00\times10^5$ dN/m$^2$. A storage elastic modulus at 150° C. ($G'_{150}$) of the non magnetic toner is in a range of $3.00\times10^3$ to $2.00\times10^4$ dN/m$^2$. The toner particles are obtained by dispersing a polymerizable monomer composition containing polymerizable monomers, the colorant, the wax component and a low-molecular weight polymer into an aqueous medium, granulating the dispersed polymerizable monomer composition, and polymerizing the polymerizable monomers in granulated particles. The low-molecular weight polymer has a weight average molecular weight (Mw) measured by means of gel permeation chromatography (GPC) in a range of 2000 to 5000.

11 Claims, 1 Drawing Sheet

U.S. PATENT DOCUMENTS

| | | | | |
|---|---|---|---|---|
| 5,753,399 | A | 5/1998 | Hayase et al. | 430/109 |
| 5,851,714 | A * | 12/1998 | Taya et al. | 430/108.3 |
| 5,955,234 | A * | 9/1999 | Matsunaga et al. | 430/109.3 |
| 6,002,903 | A | 12/1999 | Hayase et al. | 399/279 |
| 6,040,104 | A * | 3/2000 | Nakamura et al. | 430/109.4 |
| 6,316,157 | B1 | 11/2001 | Yoshikawa et al. | 430/110 |
| 6,544,708 | B2 | 4/2003 | Komoto et al. | 430/124 |
| 6,929,894 | B2 * | 8/2005 | Sugahara et al. | 430/108.3 |
| 7,125,636 | B2 | 10/2006 | Miyazaki et al. | 430/108.1 |
| 7,241,546 | B2 | 7/2007 | Moriki et al. | 430/110.3 |
| 7,250,241 | B2 | 7/2007 | Ayaki et al. | 430/108.4 |
| 2004/0234878 | A1 | 11/2004 | Miyazaki et al. | 430/108.1 |
| 2007/0212631 | A1 | 9/2007 | Abe et al. | 430/109.3 |
| 2007/0231718 | A1 | 10/2007 | Moriki et al. | 430/45.54 |

FOREIGN PATENT DOCUMENTS

| | | | |
|---|---|---|---|
| EP | 0743563 | A2 | 5/1996 |
| EP | 0926565 | A1 | 12/1998 |
| JP | 01-109359 | | 4/1989 |
| JP | 02-079860 | | 3/1990 |
| JP | 03-050559 | | 3/1991 |
| JP | 06-059502 | | 3/1994 |
| JP | 08-054750 | | 2/1996 |
| JP | 09-034163 | | 2/1997 |
| JP | 2002-013196 | | 1/2002 |
| JP | 2004-151638 | | 5/2004 |
| JP | 2004-157342 | | 6/2004 |
| JP | 2004-264484 | | 9/2004 |
| JP | 2004-333968 | | 11/2004 |

OTHER PUBLICATIONS

Lee et al., "The Glass Transition Temperatures of Polymers," *Polymer Handbook*, John Wiley & Sons, 140-192 (1975).

PCT Notification Concerning Transmittal of International Preliminary Report on Patentability (Chapter 1 of the Patent Cooperation Treaty) (Form PCT/IB/326), dated Jul. 17, 2008.

International Preliminary Report on Patentability (Chapter 1 of the Patent Cooperation Treaty) (Form PCT/IB/373), dated Jul. 17, 2008.

Written Opinion of the International Search Authority (Form PCT/ISA/237), regarding International Application No. PCT/JP2006/313351, dated Jul. 17, 2008.

* cited by examiner

NON-MAGNETIC TONER

TECHNICAL FIELD

This application claims priority from Japanese Patent Application No. 2006-001074 filed on Jan. 6, 2006 and Japanese Patent Application No. 2006-060682 filed on Mar. 7, 2006, which are hereby incorporated by reference herein.

The present invention relates to a toner for use in a recording method utilizing an electrophotographic method, an electrostatic recording method, a magnetic recording method, a toner jet method, or the like.

BACKGROUND ART

A large number of electrophotographic methods have been conventionally known. A general electrophotographic method involves: utilizing a photoconductive substance; forming an electrostatic latent image on a photosensitive member by using various means; developing the latent image with toner to provide a visible image; transferring the toner onto a recording material (transfer material) such as paper as required; and fixing the toner image to the recording material by using heat or pressure to provide a copied article. The toner remaining on the photosensitive member without being transferred is cleaned by means of various methods, and then the above steps are repeated.

In an electrophotographic method, the step of developing an electrostatic latent image is intended for forming an image on the electrostatic latent image by utilizing an electrostatic interaction between a charged toner particle and the electrostatic latent image. Examples of a method of developing an electrostatic latent image by using toner are as follows: a magnetic mono component development method involving the use of magnetic toner obtained by dispersing a magnetic material into a resin; a non-magnetic mono component development method in which non-magnetic toner is charged by using a charge-providing member such as an elastic blade so that the toner can be used for development; and a two component development method involving mixing non-magnetic toner with a magnetic carrier; and so on.

At present, a technique for exposing a photosensitive member by using a laser beam having a small diameter and the like has developed, and an electrostatic latent image has become fine. An electrostatic latent image may be faithfully developed and improved image quality may be outputted, therefore, reductions in diameters of toner particles and carrier particles have progressed in any one of the above development methods. In particular, attempts have been frequently made to reduce the average particle diameter of toner to improve image quality.

A reduction in average particle diameter of toner is an effective way to improve image quality properties, in particular, granularity and character reproducibility. However, the reduction still involves problems to be alleviated in terms of specific image quality items, in particular, fogging at the time of durable printing, fusion to a photosensitive member, toner scattering, and the like.

A possible cause for the problems is a reduction in charge amount of toner due to the following two facts: the fact that an external additive added to a toner particle deteriorates owing to the long-term use of toner and the fact that a charge-providing member such as a sleeve or a carrier and a regulating member for keeping the coating property of toner on a sleeve at a predetermined value are contaminated by the toner or the external additive, that is, spent occurs. The phenomenon is apt to occur when the size of toner is reduced. To be specific, triboelectric charging is performed by a physical external force such as contact or collision between toner and a sleeve in a mono component developer or between toner and a carrier in a two component developer. As a result, none of the toner, a charge-providing member (such as a sleeve or a carrier), and a regulating member can be prevented from being damaged. For example, in the case of the toner, an external additive added to the surface of the toner may be embedded in the toner, or a toner component may fall out. In the case of the charge-providing member or the regulating member, such members may be contaminated by a toner component containing an external additive, or a coat component with which the charge-providing member is coated so that charging is properly stabilized may wear or be destroyed. Furthermore, a photosensitive member or a charging member for the photosensitive member may be contaminated by an external additive liberated from the toner. As the number of printing increases, those damages preclude the maintenance of the initial properties of a developer, and become causes of fogging, contamination in a machine, and fluctuation in image density.

By the way, the incorporation of a release agent into a toner particle has been disclosed in a large number of documents (see, for example, Patent Document 1, Patent Document 2, and Patent Document 3).

A release agent is used for improving offset resistance upon low-temperature fixation or high-temperature fixation of toner, or for improving fixing ability upon low-temperature fixation. On the other hand, the release agent reduces the blocking resistance of toner or reduces the developing ability of the toner owing to a temperature increase in a developing device. In addition, when toner is left for a long time period, a release agent exudes to the surface of toner particle, so developing ability may be reduced.

In addition, there has been proposed that oilless fixation can be achieved by specifying the elastic modulus of toner containing release agent (see Patent Document 4 and Patent Document 5). Each of those documents does describe that the compatibility between OHP transparency and hot offset resistance certainly can be achieved by specifying viscoelasticity near a fixation set temperature of 150° C. or 170° C.

Furthermore, there has been disclosed that it can achieve the compatibility between low-temperature fixing ability and offset resistance can be achieved by specifying viscoelasticity in each of two temperature regions which are the temperature region of 60 to 80° C. and the temperature region of 130 to 190° C. (see Patent Document 6, Patent Document 7, and Patent Document 8).

Furthermore, there has been disclosed that the compatibility between an additional improvement in fixing ability and developing ability can be achieved by specifying the local maximal value and local minimal value of a loss tangent (tan δ) as a ratio between a storage elastic modulus (G') and a loss elastic modulus (G") for the viscoelastic property of toner (see, for example, Patent Document 9, Patent Document 10, and Patent Document 11).

However, problems still remain regarding how to provide developing ability that is stable for a long time period upon temperature increase in a developing device due to continuous paper transport while maintaining good fixing ability.

[Patent Document 1] JP 3-50559 A
[Patent Document 2] JP 2-79860 A
[Patent Document 3] JP 1-109359 A
[Patent Document 4] JP 6-59502 A
[Patent Document 5] JP 8-54750 A
[Patent Document 6] JP 9-34163 A
[Patent Document 7] JP 2002-13196 A

[Patent Document 8] JP 2004-333968 A
[Patent Document 9] JP 2004-151638 A
[Patent Document 10] JP 2004-157342 A
[Patent Document 11] JP 2004-264484 A

DISCLOSURE OF INVENTION

An object of the present invention is to provide a toner excellent in fixing ability and developing ability.

To be specific, an object of the present invention is to provide a toner which hardly causes the contamination of a charge-providing member, a regulating member, or a charging member for a photosensitive member even when a large number of sheets are continuously printed while good low-temperature fixing ability and high gloss are maintained even at a high speed and which provides an image having a stabilized image density and no fogging and excellent in durable stability.

The inventions for solving the above problems are described as follows.

<1> A non-magnetic toner including: toner particles each containing at least a binder resin, a colorant, and a wax component; and an inorganic fine powder, wherein: a storage elastic modulus at 110° C. ($G'_{110}$) of the non-magnetic toner is in a range of $2.00\times10^4$ to $2.00\times10^5$ dN/m$^2$; a storage elastic modulus at 150° C. ($G'_{150}$) of the non-magnetic toner is in a range of $3.00\times10^3$ to $2.00\times10^4$ dN/m$^2$; in a differential curve obtained by differentiating a temperature-storage elastic modulus curve in which an axis of abscissa indicates a temperature and an axis of ordinate indicates a common logarithm LogG' of a storage elastic modulus G' with respect to a temperature, when a temperature at which the differential curve shows a minimum value in a temperature region of 60 to 130° C. is denoted by $T_0$, a straight line having a largest gradient out of straight lines each of which is drawn to connect a point on the differential curve at a temperature of $T_0$+a (° C.) and a point on the differential curve at a temperature of ($T_0$+a)+1 (° C.) [where a represents an integer of 0 to 9] is denoted by A, a straight line having a smallest gradient out of straight lines each of which is drawn to connect a point on the differential curve at a temperature of $T_0$+b (° C.) and a point on the differential curve at a temperature of ($T_0$+b)+10 (° C.) [where b represents an integer of 0 or more] is denoted by B, and a straight line having a largest gradient out of straight lines each of which is drawn to connect a point on the differential curve at a temperature of $T_0$+c (° C.) and a point on the differential curve at a temperature of ($T_0$+c)+10 (° C.) [where c represents an integer larger than "a value b when a straight line B is given"] is denoted by C, a temperature width $\Delta T_A$ from $T_0$ to a point of intersection of the straight lines A and B satisfies a relationship of 1° C.$\leqq\Delta T_A\leqq$20° C.; and a temperature $T_{BC}$ at which a point of intersection of the straight lines B and C is present satisfies a relationship of 100° C.$\leqq T_{BC}\leqq$120° C.

<2> A non-magnetic toner according to the above item <1>, wherein: a loss tangent tan δ represented as a ratio of the loss elastic modulus G" of the non-magnetic toner to a storage elastic modulus G' of the non-magnetic toner (G"/G') has local maximal values (P0 and P1) in a range of 68 to 85° C. and a range of 110 to 135° C., respectively; and a difference between a local maximal value tan $\delta_{p1}$ of the loss tangent present in the range of 110 to 135° C. and a loss tangent tan $\delta_{170}$ at 170° C. is 0.60 or more.

<3> A non-magnetic toner according to the above item <1> or <2>, wherein a ratio of a storage elastic modulus at 80° C. ($G'_{80}$) of the non-magnetic toner to a storage elastic modulus at 100° C. ($G'_{100}$) of the non-magnetic toner ($G'_{80}/G'_{100}$) is in a range of 10 to 30.

<4> A non-magnetic toner according to any one of the above items <1> to <3>, wherein a ratio of a storage elastic modulus at 100° C. ($G'_{100}$) of the non-magnetic toner to a storage elastic modulus at 120° C. ($G'_{120}$) of the non-magnetic toner ($G'_{100}/G'_{120}$) is in a range of 5 to 30.

<5> A non-magnetic toner according to any one of the above items <1> to <4>, wherein a ratio of a storage elastic modulus at 120° C. ($G'_{120}$) of the non-magnetic toner to a storage elastic modulus at 150° C. ($G'_{150}$) of the non-magnetic toner ($G'_{120}/G'_{150}$) is in a range of 3 to 10.

<6> A non-magnetic toner according to any one of the above items <1> to <5>, wherein the binder resin contains a low-molecular weight polymer having a weight average molecular weight (Mw) measured by means of gel permeation chromatography (GPC) of 2,000 to 5,000 and a glass transition temperature of 52 to 58° C.

<7> A non-magnetic toner according to any one of the above items <1> to <6>, wherein the wax component contains a hydrocarbon-based wax, and a content of the wax component is 4 to 15 parts by mass with respect to 100 parts by mass of the binder resin.

<8> A non-magnetic toner according to any one of the above items <1> to <7>, wherein the wax component has a maximum heat absorption peak in a temperature range of 60 to 120° C. in a heat absorption curve upon temperature increase measured by using a differential scanning calorimeter (DSC).

<9> A non-magnetic toner according to any one of the above items <1> to <8>, wherein a weight average molecular weight (Mw) of the wax component measured by means of gel permeation chromatography (GPC) is in a range of 300 to 4,000.

<10> A non-magnetic toner according to any one of the above items <1> to <9>, wherein a weight average molecular weight (Mw) of the non-magnetic toner measured by means of gel permeation chromatography (GPC) of tetrahydrofuran (THF) soluble component is in a range of 15,000 to 90,000.

<11> A non-magnetic toner according to any one of the above items <1> to <10>, wherein a content of tetrahydrofuran (THF) insoluble component in a resin component in the non-magnetic toner is 5.0 mass % or less.

<12> A non-magnetic toner according to any one of the above items <1> to <11>, wherein a weight average particle diameter (D4) of the non-magnetic toner is in a range of 4.0 to 9.0 μm.

<13> A non-magnetic toner according to any one of the above items <1> to <12>, wherein the toner particles are produced in an aqueous medium.

<14> A non-magnetic toner according to any one of the above items <1> to <13>, wherein the toner particles are obtained by dispersing a polymerizable monomer composition containing at least polymerizable monomers, the colorant, and the wax component into an aqueous medium, by granulating the resultant, and by polymerizing the polymerizable monomers.

BEST MODE FOR CARRYING OUT THE INVENTION

Figure 1:
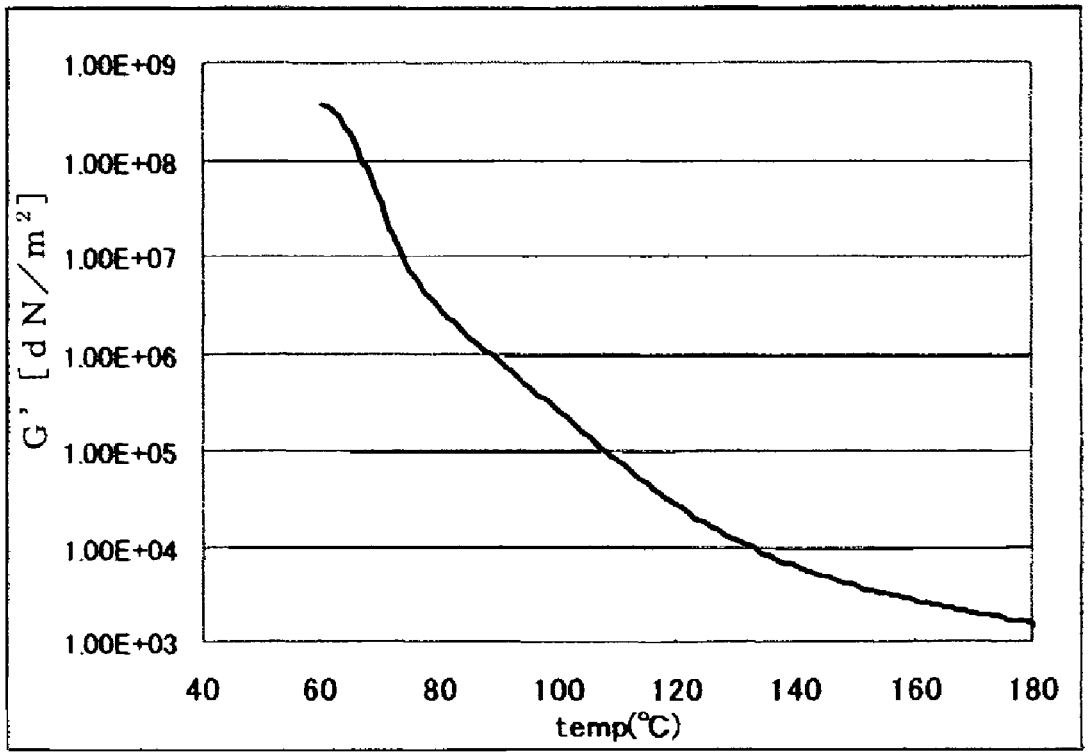
FIG. 1 shows a relationship between the storage elastic modulus of a toner of the present invention and a temperature and a differential curve obtained by differentiating the common logarithm of a storage elastic modulus with respect to a temperature.
Figure 1:
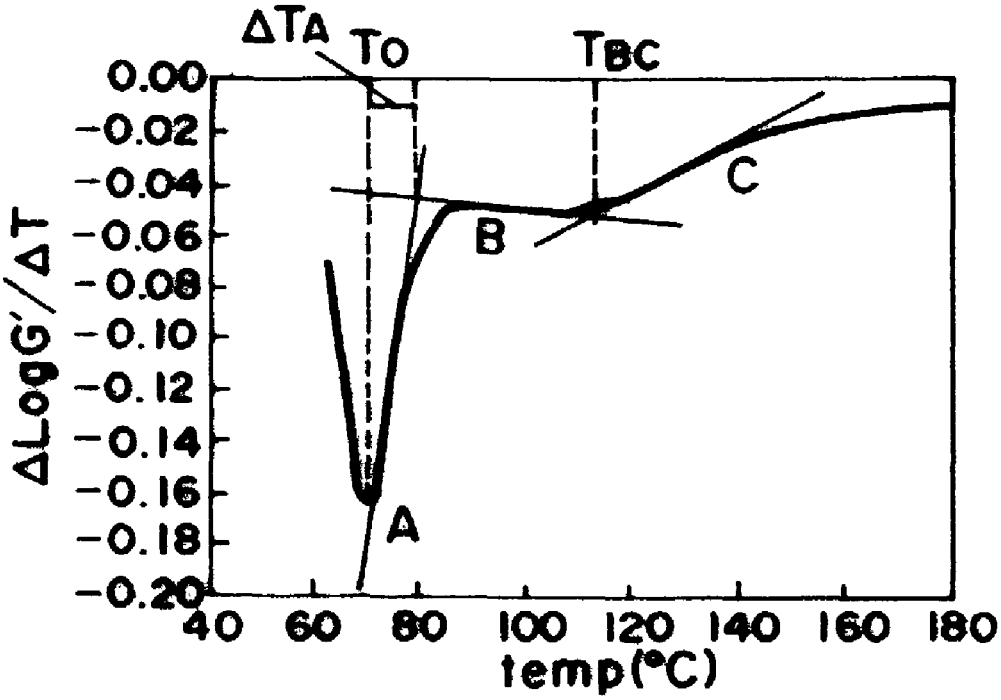

A toner of the present invention is a non-magnetic toner including: toner particles each containing at least a binder resin, a colorant, and a wax component; and an inorganic fine powder, and is characterized in that: the storage elastic modulus at 110° C. ($G'_{110}$) of the toner is in a range of $2.00\times10^4$ to $2.00\times10^5$ dN/m$^2$; the storage elastic modulus at 150° C. ($G'_{150}$) of the toner is in a range of $3.00\times10^3$ to $2.00\times10^4$ dN/m$^2$; in a differential curve obtained by differentiating a temperature-storage elastic modulus curve in which an axis of abscissa indicates a temperature and an axis of ordinate indicates a common logarithm LogG' of a storage elastic modulus G' with respect to a temperature, when the temperature at which the differential curve shows the minimum value in the temperature region of 60 to 130° C. is denoted by $T_0$, a straight line having the largest gradient out of straight lines each of which is drawn to connect a point on the differential curve at a temperature of $T_0$+a (° C.) and a point on the differential curve at a temperature of ($T_0$+a)+1 (° C.) [where a represents an integer of 0 to 9] is denoted by A, a straight line having the smallest gradient out of straight lines each of which is drawn to connect a point on the differential curve at a temperature of $T_0$+b (° C.) and a point on the differential curve at a temperature of ($T_0$+b)+10 (° C.) [where b represents an integer of 0 or more] is denoted by B, and a straight line having the largest gradient out of straight lines each of which is drawn to connect a point on the differential curve at a temperature of $T_0$+c (° C.) and a point on the differential curve at a temperature of ($T_0$+c)+10 (° C.) [where c represents an integer larger than "a value b when a straight line B is given"] is denoted by C, a temperature width $\Delta T_A$ from $T_0$ the point of intersection of the straight lines A and B satisfies the relationship of 1° C.$\leqq\Delta T_A\leqq$20° C.; and a temperature $T_{BC}$ at which the point of intersection of the straight lines B and C is present satisfies the relationship of 100° C.$\leqq T_{BC}\leqq$120° C.

The toner of the present invention includes the wax component, the storage elastic modulus at 110° C. ($G'_{110}$) of the toner is in a range of $2.00\times10^4$ to $2.00\times10^5$ dN/m$^2$, and the storage elastic modulus at 150° C. ($G'_{150}$) of the toner is in a range of $3.00\times10^3$ to $2.00\times10^4$ dN/m$^2$. As a result, the toner shows good low-temperature fixing ability and good releasability. Furthermore, a differential curve obtained by differentiating the common logarithm LogG' of a storage elastic modulus G' with respect to a temperature has such characteristic as that of the present invention, so a reduction in developing ability can be suppressed even upon temperature increase in a developing device due to continuous paper transport.

When $G'_{110}$ is less than $2.00\times10^4$ dN/m$^2$ or $G'_{150}$ is less than $3.00\times10^3$ dN/m$^2$, the fusion of the toner to a charge-providing member or a regulating member is apt to occur owing to an influence of a temperature increase in a developing device. On the other hand, when $G'_{110}$ exceeds $2.00\times10^5$ dN/m$^2$ or $G'_{150}$ exceeds $2.00\times10^4$ dN/m$^2$, a charge-providing member, a regulating member, and a charging member for a photosensitive member are apt to be contaminated by an external additive liberated from the toner.

In general, when the temperature in a developing device increases owing to continuous paper transport, toner is often damaged by a physical external force such as contact or collision with a charge-providing member or with a regulating member for keeping the coating amount of the toner on a sleeve at a predetermined value.

As shown in FIG. 1, the toner of the present invention has the temperature $T_0$ at which a differential curve obtained by differentiating the common logarithm LogG' of the storage elastic modulus G' of the toner with respect to a temperature shows the minimum value in a temperature region of 60 to 130° C., and the straight lines A, B, and C as described above can be drawn from the temperature $T_0$ toward higher temperatures. Furthermore, the toner of the present invention has a point of intersection ($T_{BC}$) of the straight lines B and C in a temperature region of 100 to 120° C. That is, the presence of the point of intersection ($T_{BC}$) in the temperature region means that the storage elastic modulus of the toner does not abruptly reduce unilaterally, but the storage elastic modulus reduces (slightly increases in some cases) while an abrupt reduction in storage elastic modulus is suppressed. Accordingly, the toner of the present invention has a region where an appropriate storage elastic modulus G' is maintained in the temperature region of $T_0+\Delta T_A$ to $T_{BC}$. The temperature region is a temperature region which the surface temperature of each of a toner carrier, a photosensitive member, and peripheral members of the toner carrier and the photosensitive member may reach when continuous image formation is performed. The toner is subjected to development in the temperature region. In such temperature region, toner is apt to be damaged when the toner receives a physical external force. In contrast, the toner of the present invention is hardly damaged by a physical external force because the toner has an appropriately high storage elastic modulus G' in the temperature region, so the occurrence of, for example, the fallout of a toner component is suppressed. In addition, the embedding of an external additive to the toner surface or the liberation of the external additive hardly occurs. Accordingly, the toner is expected to have a constitution effective in preventing the contamination of each of the toner carrier, the photosensitive member, and the peripheral members of the toner carrier and the photosensitive member (such as a charging member and a toner regulating member). Furthermore, the toner of the present invention can provide an image causing neither fogging nor fluctuation in image density and excellent in durable stability because the initial properties of the toner and of each member can be maintained.

The toner of the present invention satisfies the relationship of 1° C.$\leqq\Delta T_A\leqq$20° C. and the relationship of 100° C.$\leqq T_{BC}\leqq$120° C. When $\Delta T_A$>20° C., an external additive is apt to liberate from the toner, and a charge-providing member, a regulating member, and a charging member for a photosensitive member are contaminated by the liberated external additive. When $T_{BC}$<100° C., the external additive is apt to be embedded in the toner surface. When $T_{BC}$>120° C., the external additive is apt to liberate from the toner, and low-temperature fixing ability degrades.

The storage elastic modulus, $\Delta T_A$, $T_{BC}$, and the like to be used in the present invention will be described.

The storage elastic modulus G' and loss elastic modulus G" of the toner in the present invention are determined through ordinary dynamic viscoelasticity measurement, and a loss tangent (tan δ) is determined by calculating a ratio of the loss elastic modulus (G") to the storage elastic modulus (G'). For example, in the present invention, they were determined by means of the following method.

A rotary planar rheometer (trade name: ARES, manufactured by TA INSTRUMENTS) is used as a measuring device. A measurement sample to be used is a toner molded into a disk-like sample having a diameter of 7.9 mm and a thickness of 2.0±0.3 mm by using a tablet molding machine at 25° C. under pressure. The sample is mounted on a parallel plate of the measuring device, and its temperature is increased from room temperature (25° C.) to 120° C. in 15 minutes. After the shape of the disk has been uniformized, the temperature of the sample is cooled to the temperature at which the measurement of viscoelasticity starts, and then the measurement is started.

The measurement is performed under the following conditions.

1. A parallel plate having a diameter of 7.9 mm is used.
2. "Frequency" is 1.0 Hz.
3. "Strain" (an initial value for an applied strain) is set to 0.1%.
4. The measurement is performed in the range of 30 to 200° C. at "Ramp Rate" (the rate of temperature increase) of 2.0° C./min.
5. "Max Applied Strain" (the maximum strain) is set to 20.0%.
6. "Max Allowed Torque" (the maximum torque) is 200.0 g·cm, and "Min Allowed Torque" (the minimum torque) is set to 0.2 g·cm.
7. "Strain Adjustment" is set to "20.0% of Current Strain".
8. "Auto Tension Direction" is set to "Compression".
9. "Initial Static Force" is set to 10.0 g, and "Auto Tension Sensitivity" is set to 40.0 g.
10. "AutoTension" operates on condition that "Sample Modulus" is $1.0\times10^3$ (Pa) or more.
11. Measurement data is taken at an interval of 30 seconds.

The measurements of the storage elastic modulus G' are converted into values for the common logarithm LogG' of the storage elastic modulus G', and the values, which are indicated by an axis of ordinate, are plotted versus a temperature, which is indicated by an axis of abscissa. After the values have been plotted, the respective points are smoothly connected, whereby a temperature-storage elastic modulus curve is obtained. Next, the gradient of the resultant temperature-storage elastic modulus curve is determined, and a differential curve obtained by differentiating the common logarithm LogG' with respect to a temperature is graphed (see, for example, FIG. 1). To be specific, the gradient of the temperature-storage elastic modulus curve is determined as the displacement of the temperature-storage elastic modulus curve between a certain temperature t (° C.) and t+1 (° C.) [where t represents an integer]. For example, the gradient between the temperature t (° C.) and t+1 (° C.) is determined as a differential value at a temperature of t+0.5 (° C.). Then, the differential values are calculated over the entire temperature region, and then the differential values, which are indicated by an axis of ordinate, are plotted versus a temperature, which is indicated by an axis of abscissa. The plotted points are smoothly connected, whereby a differential curve is obtained. The temperature at which the resultant differential curve shows the minimum value in the temperature region of 60 to 130° C. is denoted by $T_0$. Next, a straight line having the largest gradient out of straight lines each of which is drawn to connect a point on the differential curve at a temperature of $T_0$+a (° C.) and a point on the differential curve at a temperature of ($T_0$+a)+1 (° C.) is denoted by A (where a represents an integer of 0 to 9). Furthermore, a straight line having the smallest gradient out of straight lines each of which is drawn to connect a point on the differential curve at a temperature of $T_0$+b (° C.) and a point on the differential curve at a temperature of ($T_0$+b)+10 (° C.) is denoted by B (where b represents an integer of 0 or more). A straight line having the largest gradient out of straight lines each of which is drawn to connect a point on the differential curve at a temperature of $T_0$+c (° C.) and a point on the differential curve at a temperature of ($T_0$+c)+10 (° C.) is denoted by C (where c represents an integer larger than "a value b when a straight line B is given").

When it is difficult to connect the plotted points smoothly, measured values may be subjected to a smoothing treatment in which three points or five points are in agreement with one another so that the measured values may be smoothly connected with ease. The term "smoothing in which three points are in agreement with one another" refers to a smoothing treatment using the average value of three points, that is, a certain point of measurement, and the preceding point of the point of measurement and the next point of the point of measurement.

In addition to the above characteristics, in the non-magnetic toner of the present invention, a loss tangent tan δ represented as a ratio of the loss elastic modulus G" of the non-magnetic toner to the storage elastic modulus G' of the non-magnetic toner (G"/G') preferably has local maximal values (P0 and P1) in the range of 68 to 85° C. and the range of 110 to 135° C., respectively.

In the toner of the present invention, the temperature ($T_{P0}$) at which the loss tangent (tan δ) shows a local maximal in the range of 68 to 85° C. corresponds to the temperature at which a resin component of the toner undergoes a transition from a glass state to a state where the resin component can be thermally denatured, and is closely related to the fixing ability of the toner. When the loss tangent has a local maximal value only in a range lower than 68° C., neither hot offset resistance nor storage stability can be satisfied. When the loss tangent has a local maximal value only in a range higher than 85° C., there is a possibility that low-temperature fixing ability cannot be achieved. The toner of the present invention achieves compatibility between hot offset resistance and low-temperature fixing ability, and shows good fixing ability because the loss tangent (tan δ) has a local maximal value in the range of 68 to 85° C.

Furthermore, in the toner of the present invention, the loss tangent (tan δ) preferably has a local maximal value even in the range of 110 to 135° C. (the temperature at which the local maximal value is present is denoted by $T_{P1}$) as well as the local maximal value in the range of 68 to 85° C. The reason for this is as described below. When the toner receives a physical external force near 110 to 135° C., the toner appropriately deforms with ease, and hardly deteriorates owing to the presence of elasticity. When a temperature increase in a developing device remarkably occurs, in particular, upon high-speed, continuous paper transport in a contact development system, the toner is often damaged by a physical external force such as contact or collision with each member and by heat generation. In contrast, the toner of the present invention has the ease with which the toner deforms and the difficulty with which the toner deteriorates at the same time owing to the foregoing reason. Accordingly, toner fusion can be suppressed, and the contamination of each of a charge-providing member, a regulating member, and a charging member for a photosensitive member by a liberated external additive can be suppressed.

Furthermore, in the toner of the present invention, a difference between a local maximal value tan $\delta_{P1}$ of the loss tangent present in the range of 110 to 135° C. and a loss tangent tan $\delta_{170}$ at 170° C. is preferably 0.60 or more. This is because, while toner fusion and the contamination of each member by a liberated external additive are suppressed, an image having high gloss while maintaining offset resistance can be provided near 170° C. (near a fixation temperature). Offset resistance cannot be satisfied when the difference is less than 0.60.

In the toner of the present invention, a ratio of the storage elastic modulus at 80° C. ($G'_{80}$) of the toner to the storage elastic modulus at 100° C. ($G'_{100}$) of the toner ($G'_{80}/G'_{100}$) is preferably in a range of 10 to 30. When the ratio $G'_{80}/G'_{100}$ is smaller than 10, the toner cannot withstand a pressure or frictional sliding force in a developing device, so toner fusion may occur. When the ratio $G'_{80}/G'_{100}$ is larger than 30, in addition to toner fusion due to a pressure or frictional sliding force in a developing device, the liberation of an external additive is apt to occur, and a charge-providing member and a regulating member are apt to be contaminated.

In the toner of the present invention, a ratio of the storage elastic modulus at 100° C. ($G'_{100}$) of the toner to the storage elastic modulus at 120° C. ($G'_{120}$) of the toner ($G'_{100}/G'_{120}$) is preferably in a range of 5 to 20. A ratio $G'_{100}/G'_{120}$ of smaller than 5 is apt to be responsible for the degradation of low-temperature fixing ability. When the ratio $G'_{100}/G'_{120}$ is larger than 20, the inside of a developing device is apt to be contaminated remarkably owing to toner fusion.

In the toner of the present invention, a ratio of the storage elastic modulus at 120° C. ($G'_{120}$) of the toner to the storage elastic modulus at 150° C. ($G'_{150}$) of the toner ($G'_{120}/G'_{150}$) is preferably in a range of 3 to 10. A ratio $G'_{120}/G'_{150}$ of smaller than 3 is apt to be responsible for the degradation of low-temperature fixing ability. When the ratio $G'_{120}/G'_{150}$ is larger than 10, there is a possibility that offset resistance upon duration can be reduced.

That is, the physical properties of the toner of the present invention are preferably controlled in such a manner that the ratio $G'_{80}/G'_{100}$ is in a range of 10 to 30, the ratio $G'_{100}/G'_{120}$ is in a range of 5 to 20, and the ratio $G'_{120}/G'_{150}$ is in a range of 3 to 10. When the physical properties of the toner are controlled as described above, a reduction in developing ability can be suppressed even upon temperature increase in a developing device due to continuous paper transport while low-temperature fixing ability is maintained. In addition, the toner is excellent in offset resistance upon duration.

The storage elastic modulus (G'), loss elastic modulus (G"), $\Delta T_A$, and $T_{BC}$ specified above are appropriately adjusted by controlling, for example, the formulation of a resin component, and the amount of a polymerization initiator and a reaction temperature at the time of polymerization.

The toner of the present invention is a non-magnetic toner including: toner particles each containing at least a binder resin, a colorant, and a wax component; and an inorganic fine powder.

The toner particles to be used in the present invention may be produced by means of any approach; provided that the particles are preferably produced by means of any one of production methods each involving granulation in an aqueous medium such as a suspension polymerization method, an emulsion polymerization method, and a suspension granulation method. In the case of toner to be produced by means of a general pulverization method, the addition of a large amount of a wax component to a toner particle involves extremely high technical difficulty. In the case of a production method involving granulating toner particles in an aqueous medium, even when a large amount of a wax component is added to each of the toner particles, the wax component is not present on a toner surface, and can be included in the toner particle. Of those production methods, the suspension polymerization method is one of the most preferable production methods because development can be stably performed for a long time period owing to the inclusion of a wax component in the toner particle and because no solvent is used so that a production cost can be reduced.

Hereinafter, a suspension polymerization method most suitable for obtaining toner particles to be used in the present invention will be exemplified, and a method of producing the toner particles will be described. A polymerizable monomer, a colorant, a wax component, any other additive in accordance with a need, and the like are uniformly dissolved or dispersed by using a dispersing device such as a homogenizer, a ball mill, a colloid mill, or an ultrasonic dispersing device. A polymerization initiator is dissolved into the resultant, whereby a polymerizable monomer composition is prepared. Next, the polymerizable monomer composition is suspended into an aqueous medium containing a dispersant, and the suspension is subjected to polymerization, whereby the toner particles are produced. The polymerization initiator may be mixed immediately before the suspension into the aqueous medium as described above, or may be added simultaneously with the addition of the other additive to the polymerizable monomer. Alternatively, immediately after granulation and before the initiation of a polymerization reaction, the polymerization initiator dissolved into the polymerizable monomer or solvent can be added.

The wax component to be used in the present invention is preferably a hydrocarbon-based wax, and the content of the wax component is preferably 4 to 15 parts by mass, or more preferably 5 to 12 parts by mass with respect to 100 parts by mass of the binder resin. When the content of the wax component is smaller than 4 parts by mass, a releasability effect upon fixation cannot be sufficiently exerted, and the winding of transfer paper is apt to occur when the temperature of a fixing body is low. In contrast, when the content is larger than 15 parts by mass, the contamination of a charge-providing member or a photosensitive member by the wax component becomes remarkable, and detrimental effects such as fogging and fusion are apt to occur.

The wax component has the maximum heat absorption peak in the temperature range of preferably 60 to 120° C., more preferably 62 to 110° C., or still more preferably 65 to 90° C. in a heat absorption curve upon temperature increase measured by using a differential scanning calorimeter (DSC). When the temperature at which the maximum heat absorption peak is present is lower than 60° C., the storage stability of the toner and developing ability such as fogging of the toner degrade. In contrast, when the temperature at which the maximum heat absorption peak is present is higher than 120° C., a plasticizing effect on the toner is so small that low-temperature fixing ability is poor.

The wax component has a weight average molecular weight (Mw) of preferably in a range of 300 to 4,000, or more preferably 500 to 2,000. When the Mw is less than 300, the wax component cannot sufficiently function as wax, and the adhesion of the toner to, or a flaw in, a fixing member is apt to occur. When the Mw exceeds 4,000, OHP transparency is apt to degrade.

Specific examples of the hydrocarbon-based wax to be used in the present invention include: petroleum-based waxes such as a paraffin wax, a microcrystalline wax, and petrolatum, and derivatives of them; a Fischer-Tropsch wax according to a Fischer-Tropsch method and a derivative of the wax; and polyolefin waxes typified by polyethylene and derivatives of them. Examples of such derivative include an oxide, a block copolymer with a vinyl monomer, and a graft denatured product. The examples further include: hardened castor oil and a derivative of the oil; a plant wax; and an animal wax. One kind of those waxes is used alone, or two or more kinds of them are used in combination.

When a hydrocarbon-based wax according to a Fischer-Tropsch method out of those waxes is used, particularly good hot offset resistance can be kept while good developing ability in contact development is maintained for a long time period. It should be noted that each of those hydrocarbon-based waxes may be added with an antioxidant to the extent that the chargeability of the toner is not affected.

The wax component to be used in the present invention preferably contains a hydrocarbon-based wax. Examples of a wax component except the hydrocarbon-based wax include an amide wax, a higher fatty acid, a long-chain alcohol, a ketone wax, and an ester wax, and derivatives of them such as graft compounds and block compounds. Two or more kinds of wax components may be used in combination as required.

Of the above respective wax components, a more preferable one is an ester wax represented by any one of the following general formulae (A) to (C):

Ester Compound A (A)

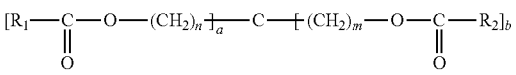

(wherein, a and b each represent an integer of 0 to 4, a+b equals 4, $R_1$ and $R_2$ each represent an organic group having 1 to 40 carbon atoms, n and m each represent an integer of 0 to 40, and n and m cannot be simultaneously 0);

Ester Compound B (B)

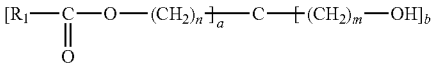

(wherein, a and b each represent an integer of 0 to 4, a+b equals 4, $R_1$ represents an organic group having 1 to 40 carbon atoms, n and m each represent an integer of 0 to 40, and n and m cannot be simultaneously 0); and Ester Compound C (C)

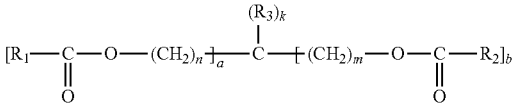

(wherein, a and b each represent an integer of 0 to 3, a+b represents an integer of 1 to 3, k represents an integer of 1 to 3, a+b+k equals 4, $R_1$ and $R_2$ each represent an organic group having 1 to 40 carbon atoms, $R_3$ represents an organic group having 1 or more carbon atoms, n and m each represent an integer of 0 to 40, and n and m cannot be simultaneously 0).

Examples of the binder resin to be used in the present invention include a styrene-acrylic copolymer, a styrene-methacrylic copolymer, an epoxy resin, and a styrene-butadiene copolymer to be generally used. A vinyl-based polymerizable monomer that can be subjected to radical polymerization can be used as the polymerizable monomer. A monofunctional polymerizable monomer or a polyfunctional polymerizable monomer can be used as the vinyl-based polymerizable monomer.

Specific examples of the polymerizable monomer to be used for a binder resin preferably include: styrene; a styrene-based monomer such as o-methylstyrene, m-methylstyrene, p-methylstyrene, m-ethylstyrene, and p-ethylstyrene; an acrylate-based monomer or methacrylate-based monomer such as methyl acrylate, methyl methacrylate, ethyl acrylate, ethyl methacrylate, propyl acrylate, propyl methacrylate, butyl acrylate, butyl methacrylate, octyl acrylate, octyl methacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate, and diethylaminoethyl methacrylate; and an ene-based monomer such as butadiene, isoprene, cyclohexene, acrylonitrile, methacrylonitrile, amide acrylate, and amide methacrylate.

One kind of those monomers is used alone, or, in general, two or more kinds of them are appropriately mixed and used in such a manner that the theoretical glass transition temperature (Tg) described in the publication Polymer Handbook, second edition, III-p139 to 192 (published by John Wiley & Sons) is in a range of 40 to 75° C. When the theoretical glass transition temperature is lower than 40° C., the toner is apt to be problematic in terms of storage stability and durability. On the other hand, when the theoretical glass transition temperature is higher than 75° C., the transparency of an OHP image reduces.

In the case where the toner of the present invention is produced, a low-molecular weight polymer is preferably added in order to introduce the rheological property of the present invention. When the toner is produced by means of a pulverization method, the low-molecular weight polymer can be added upon melting and kneading with any other resin component or the like. In addition, when the toner is produced by means of a suspension polymerization method, the low-molecular weight polymer can be added to a polymerizable monomer composition. The low-molecular weight polymer has a weight average molecular weight (Mw) measured by means of gel permeation chromatography (GPC) in the range of preferably 2,000 to 5,000 and a ratio Mw/Mn of preferably less than 4.5, or more preferably less than 3.0. In addition, the low-molecular weight polymer preferably has a glass transition temperature in a range of 52 to 58° C. It should be noted that the low-molecular weight polymer functions as a binder resin.

Examples of the low-molecular weight polymer include low-molecular weight polystyrene, a low-molecular weight styrene-acrylate copolymer, and a low-molecular weight styrene-methacrylate copolymer and so on.

In the present invention, a polar resin such as a polyester resin or a polycarbonate resin can be used in combination with the above-described binder resin.

For example, in the case where the toner is directly produced by means of a suspension polymerization method or the like, when a polar resin is added at the time of a polymerization reaction commencing on a dispersing step and ending on a polymerizing step, the added polar resin can form a thin layer on the surface of each toner particle in accordance with a balance between the polarity of a polymerizable monomer composition serving as toner particles and the polarity of an aqueous dispersion medium. Alternatively, the state of presence of the polar resin can be controlled in such a manner that the polar resin is present to slant from the surface of each toner particle toward the center of the particle. At this time, the use of a polar resin that may interact with a colorant in the toner can provide a desirable state of presence of the colorant in the toner.

The amount of the polar resin to be added is preferably 1 to 25 parts by mass, or more preferably 2 to 15 parts by mass with respect to 100 parts by mass of the binder resin. An amount of less than 1 part by mass is not preferable because the state of presence of the polar resin in each toner particle becomes nonuniform. In contrast, an amount in excess of 25 parts by mass is not preferable either because the thin layer of the polar resin to be formed on the surface of each toner particle becomes thick.

Specific examples of the polar resin to be used in the present invention include a polyester resin, an epoxy resin, a styrene-acrylic acid copolymer, a styrene-methacrylic acid copolymer, and a styrene-maleic acid copolymer. A polyester resin having a peak molecular weight of 3,000 to 10,000 is a particularly preferable polar resin because the resin can improve the fluidity, negative triboelectric charging property, and transparency of a toner particle.

In the present invention, a cross-linking agent may be added at the time of the synthesis of the binder resin for improving the mechanical strength of a toner particle and for controlling the molecular weight of the toner particle.

Examples of the cross-linking agents to be used in the present invention include, as a bifunctional cross-linking agent, divinylbenzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400, and #600, dipropylene glycol diacrylate, polypropylene glycol diacrylate, polyester-type diacrylates (MANDA, Nippon Kayaku Co., Ltd.), and those obtained by changing the above diacylates to dimethacrylates.

Examples of the polyfunctional cross-linking agents include pentaerythritol triacrylate, trimethylolethane triacrylate, trimethylolpropane triacrylate, tetramethylolmethane tetraacrylate, oligoester acrylate and methacrylate thereof, 2,2-bis(4-mathacryloxypolyethoxyphenyl)propane, diallylphthalate, triallylcyanurate, triallylisocyanurate, and triallyltrimelitate. An amount of those cross-linking agents to be added is preferably 0.05 to 10 parts by mass, more preferably 0.1 to 5 parts by mass with respect to 100 parts by mass of the polymerizable monomer.

Specific examples of the polymerization initiators include: azo type or diazo type polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and the peroxide-based polymerization initiator such as benzoylperoxide, methylethylketoneperoxide, diisopropylperoxycarbonate, cumene hydroperoxide, 2,4-dichlorobenzoylperoxide, lauroylperoxide, and tert-butyl-peroxypivalate.

The usage of each of those polymerization initiators, which varies depending on the target degree of polymerization, is generally 3 to 20 parts by mass with respect to 100 parts by mass of the polymerizable monomer. The number of kinds of polymerization initiators to be used varies slightly depending on a polymerization method. One kind of the polymerization initiators may be used alone, or two or more kinds of them may be used as a mixture with reference to a 10-hour half-life temperature.

The toner of the present invention contains a colorant as an essential ingredient so that coloring power is imparted to the toner. Examples of the colorant to be preferably used in the present invention include the following organic pigments or organic dyes.

For the organic pigment or the organic dye as a cyan type colorant, a copper phthalocyanine compound and derivatives thereof, an anthraquinone compound, a lake compound of basic dyes, and the like may be used. Specific examples thereof include C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue 66 and so on.

For the organic pigment or the organic dye as a magenta type colorant, a condensed azo compound, a diketopyrrolopyrrole compound, anthraquinone, a quinacridone compound, a lake compound of basic dyes, a naphthol compound, a benzimidazolone compound, a thioindigo compound, a perylene compound, and the like may be used. Specific examples thereof include C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254.

For the organic pigment or the organic dye as a yellow type colorant, the compound represented by a condensed azo compound, an isoindolinone compound, an anthraquinone compound, azo metallic complexes, a methine compound, or an allylamide compound may be used. Specific examples thereof include C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194 and so on.

A black colorant to be used is carbon black or a colorant toned to have a black color by using the above yellow-based/magenta-based/cyan-based colorants.

One kind of those colorants can be used alone, or two or more kinds of them can be used as a mixture. Furthermore, each of those colorants can be used in a solid solution state. The colorant to be used in the toner of the present invention is selected in terms of hue angle, chroma saturation, brightness, light resistance, OHP transparency, and dispersibility into the toner.

The amount of the colorant to be added is preferably 1 to 20 parts by mass with respect to 100 parts by mass of the binder resin.

In the present invention, when the toner is produced by means of a polymerization method, attention must be paid to the polymerization inhibiting property and aqueous phase transition property possessed by the colorant. Accordingly, the colorant is preferably subjected to surface modification such as a hydrophobic treatment with a substance that does no inhibit polymerization. In particular, attention should be paid to the use of dye series and carbon black because most of them have polymerization inhibiting property. An example of a preferable method of treating the surface of each of those dye series is a method involving polymerizing a polymerizable monomer in the presence of those dyes in advance, and the resultant colored polymer is added to a monomer system.

In addition, carbon black may be subjected to a treatment with a substance that reacts with a surface functional group of carbon black such as polyorganosiloxane as well as a treatment similar to that in the case of the dyes.

Any one of known inorganic and organic dispersants can be used as the dispersant to be used at the time of the preparation of the aqueous dispersion medium.

Specific examples of the inorganic dispersant include tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersant include polyvinyl alcohol, gelatin, methylcellulose, methylhydroxypropylcellulose, ethylcellulose, sodium salts of carboxymethylcellulose, and starch.

A commercially available nonionic, anionic, or cationic surface active agent can be used. Examples of the surface active agent like this include sodium dodecyl sulfate, sodium tetradecyl sulfate, sodium pentadecyl sulfate, sodium octyl sulfate, sodium oleate, sodium laurate, potassium stearate, and calcium oleate.

An inorganic, hardly water-soluble dispersant is preferably used as the dispersant to be used at the time of the preparation of the aqueous dispersion medium. A hardly water-soluble, inorganic dispersant which is soluble in an acid is particularly preferably used.

In addition, in the present invention, when an aqueous dispersion medium is prepared by using a hardly water-soluble, inorganic dispersant, the usage of such dispersant is preferably 0.2 to 2.0 parts by mass with respect to 100 parts by mass of a polymerizable vinyl-based monomer. In addition, in the present invention, an aqueous dispersion medium is preferably prepared with water in an amount of 300 to 3,000 parts by mass with respect to 100 parts by mass of a polymerizable monomer composition.

In the present invention, when an aqueous dispersion medium into which such hardly water-soluble, inorganic dispersant as described above is dispersed is prepared, a commercially available dispersant may be dispersed as it is. In addition, in order to obtain dispersant particles each having a fine, uniform grain size, an aqueous dispersion medium may be prepared by producing such hardly water-soluble, inorganic dispersant as described above in a liquid medium such as water under high-speed stirring. For example, when tricalcium phosphate is used as a dispersant, a preferable dispersant can be obtained by mixing an aqueous solution of sodium phosphate and an aqueous solution of calcium chloride under high-speed stirring to form fine particles of tricalcium phosphate.

In the toner of the present invention, each toner particle can be mixed with a charge control agent as required before use. Blending the charge control agent can stabilize charging property and can control an optimum triboelectric charge amount in accordance with a developing system.

A known agent can be used as the charge control agent. In particular, a charge control agent having a high charging speed and capable of stably maintaining a constant charge amount is preferable. Furthermore, when toner is directly produced by means of a polymerization method, a charge control agent having low polymerization inhibiting property and substantially free of any matter soluble in an aqueous dispersion medium is particularly preferable.

The organic metal compound and the chelate compound can be used effectively as a charge control agent for controlling a toner to negative charge. Examples of the charge control agent include a monoazo metal compound, an acetylacetone metal compound, a metal compound composed of aromatic oxycarbonate, aromatic dicarbonate, oxycarbonate, or dicarbonate. Examples of the other charge control agents include: aromatic oxycarbonate, aromatic monocarbonate and aromatic polycarbonate, and metal salts thereof, anhydride thereof, esters thereof; and phenol derivatives such as bisphenol. In addition, examples of the charge control agent also include urea derivatives, a metal-containing salicylic compound, a metal-containing naphthoic acid compound, a boric compound, a quaternary ammonium salt, calixarene, a resin type charge control agent.

Examples of a charge control agent for controlling a toner to positive charge include: nigrosine and nigrosine-modified products modified by aliphatic acid metal salts or the like; a guanidine compound; an imidazole compound; quaternary ammonium salts such as tributylbenzylammonium-1-hydroxy-4-naphthosulfonic acid salts and tetrabutylammonium tetrafluoroborate, onium salts such as a phosphonium salt which are analogs thereof, and a lake pigment thereof; a triphenylmethane dye and a lake pigment thereof such as phosphorus tungstate, phosphorus molybdate, phosphorus tungstatemolybdate, tannin acid, lauric acid, gallic acid, ferricyanide, ferrocyanide; metal salts of higher fatty acids; diorganotin oxides such as dibutyltin oxide, dioctyltin oxide, and dicyclohexyltin oxide; and diorganotin borates such as dibutyltin borate, dioctyltin borate, and dicyclohexyltin borate; and resin type charge control agents.

The toner of the present invention can contain one kind of those charge control agents alone, or can contain two or more kinds of them in combination.

Of those charge control agents, a metal-containing salicylic acid-based compound is preferable in order that an effect of the present invention may be sufficiently exerted. In particular, the metal is preferably aluminum or zirconium. The most preferable charge control agent is an aluminum 3,5-di-tert-butylsalicylate compound.

The amount of the charge control agent to be added is preferably 0.01 to 20 parts by mass, or more preferably 0.5 to 10 parts by mass with respect to 100 parts by mass of the binder resin. In addition, the addition of a charge control agent is not essential to the toner of the present invention. The active utilization of triboelectric charging between a member for regulating the thickness of the toner and a toner carrier eliminates the need for adding a charge control agent to the toner.

The toner particles of the present invention are added with an inorganic fine powder as a plasticizer.

Examples of the inorganic fine powder to be added to the toner particles of the present invention include fine powders such as: silica, titanium oxide, and alumina, and double oxides of them. Of the inorganic fine powders, titanium oxide is preferable.

Examples of silica as the above described inorganic fine powder include: so-called dry silica (also referred to as dry-method silica or fumed silica) produced by vapor phase oxidation of a silicon halide compound; and so-called wet silica produced from water glass or the like. The dry silica is a preferable inorganic fine powder because it has a small amount of silanol groups on its surface and in the silica fine powder and produces a small amount of a production residue such as $Na_2O$ or $SO_3^{2-}$. In addition, a composite fine powder of the dry silica and any other metal oxide can be obtained by using a metal halogen compound such as aluminum chloride or titanium chloride in combination with a silicon halogen compound in a production step, and such composite fine powder is also included in the scope of the dry silica.

The number average primary particle diameter of the inorganic fine powder is preferably 4 to 80 nm, and the amount of the inorganic fine powder to be added is preferably 0.1 to 4.0 mass % with respect to the entirety of the toner.

When the number average primary particle diameter of the inorganic fine powder is larger than 80 nm, good fluidity of the toner cannot be obtained, and the provision of charge to each toner particle is apt to be nonuniform. The nonuniformity leads to the nonuniformity of triboelectric chargeability at a low humidity. Accordingly, a problem such as an increase in fogging, a reduction in image density, or a reduction in durability inevitably occurs.

When the number average primary particle diameter of the inorganic fine powder is smaller than 4 nm, aggregability between inorganic fine particles increases, so the inorganic fine powder tends to behave not as primary particles but as an aggregate having so strong aggregability that the aggregate is hardly shredded by a shredding treatment and having a wide particle size distribution. Such inorganic fine powder is apt to cause an image failure due to, for example, the development of the aggregate or damage to an image-bearing member or to a toner carrier.

The number average primary particle diameter of the inorganic fine powder is more preferably 6 to 35 nm in order to uniformize the charge distribution of the toner particles additionally.

The number average particle diameter of the inorganic fine powder can be measured as described below. While a photograph of the toner zoomed in by means of a scanning electron microscope and a photograph of the toner in which an element in the inorganic fine powder is mapped by means of elemental analysis means such as an X-ray microanalyzer (XMA) attached to the scanning electron microscope are compared, the diameters of 100 or more primary particles of the inorganic fine powder adhering to, or liberated from, the toner surface are measured, and the number average primary particle diameter is determined.

The amount of an inorganic fine powder having a number average primary particle diameter of 4 to 80 nm to be added is preferably 0.1 to 4.0 parts by mass with respect to 100 parts by mass of the toner particles. When the amount of the powder to be added is less than 0.1 part by mass, an effect of the addition is not sufficient. When the amount exceeds 4.0 parts by mass, the fixing ability degrades.

The content of the inorganic fine powder can be determined by using an analytical curve created from a standard sample by means of fluorescent X-ray analysis.

The inorganic fine powder is added for improving the fluidity of the toner and for uniformizing the charging of toner base particles. An inorganic fine powder subjected to a hydrophobic treatment is preferably used because subjecting the inorganic fine powder to a treatment such as a hydrophobic treatment can impart functions of, for example, adjusting the charge amount of the toner, improving environmental stability, and improving properties in a high-humidity environment to the toner. When the inorganic fine powder added to the toner absorbs moisture, the charge amount of the toner remarkably reduces, so reductions in developing ability and transferability are apt to occur.

Examples of a treatment agent for the hydrophobic treatment of the inorganic fine powder include undenatured silicone varnishes, various denatured silicone varnishes, undenatured silicone oils, various denatured silicone oils, silane compounds, silane coupling agents, other organic silicon compounds, and organic titanium compounds. One kind of those treatment agents may be used alone, or two or more kinds of them may be used in combination.

An inorganic fine powder treated with a silicone oil out of those treatment agents is preferable. An inorganic fine powder subjected to a treatment with a silicone oil and a hydrophobic treatment obtained by: subjecting an inorganic fine powder to a hydrophobic treatment with a coupling agent; and treating the inorganic fine powder with a silicone oil simultaneously with or after the hydrophobic treatment is more preferable for maintaining a high charge amount of each toner particle even in a high-humidity environment and for reducing selective developing ability.

The toner of the present invention has a weight average molecular weight Mw measured by means of gel permeation chromatography (GPC) of tetrahydrofuran (THF) soluble component of preferably 15,000 to 90,000, or more preferably 20,000 to 60,000. When the Mw exceeds 90,000, a reduction in dispersibility of various materials, in particular, the colorant occurs, with the result that a reduction in coloring power and the degradation of OHP transparency are apt to occur.

The content of tetrahydrofuran (THF) insoluble component in a resin component in the toner of the present invention is preferably 5.0 mass % or less. When the content exceeds 5.0 mass %, a reduction in gloss of a print image is apt to occur.

The toner of the present invention has a weight average particle diameter (D4) of preferably 4.0 to 9.0 μm, or more preferably 4.9 to 7.9 μm. When the weight average particle diameter (D4) is less than 4.0 μm, fogging becomes remarkable and transferability degrades. When the weight average particle diameter (D4) exceeds 9.0 μm, the scattering of a character or of a line image is apt to occur, so high resolution is hardly obtained.

Hereinafter, a method of measuring each of various properties except the storage elastic modulus G' according to the present invention will be described.

(1) Measurement of Temperature at which Maximum Heat Absorption Peak is Present in DSC Heat Absorption Curve of Wax Component For example, a DSC-7 manufactured by Perkin Elmer Co., Ltd., or a DSC-2920 manufactured by TA Instruments Japan Inc. can be used in the DSC measurement of the wax component in the present invention with a differential scanning calorimeter. In the present invention, the temperature at which the maximum heat absorption peak of the wax component is present is measured by using a DSC-2920 manufactured by TA Instruments Japan Inc., and the temperature at which the maximum heat absorption peak of the wax component is present is obtained from the resultant DSC curve upon temperature increase. An aluminum pan is used for a measurement sample, and an empty pan is set as a control. The temperature of the measurement sample is increased from 20° C. to 180° C. at a rate of temperature increase of 2° C./min while a modulation having an amplitude of ±1.5° C. and a period of 1/min is applied.

In addition, in the present invention, a height ΔH from a base line per unit mass to a peak top by means of the above DSC measurement method (ΔH: a value obtained by dividing the height of the measured peak by the mass of the measurement sample (mW/mg)) is defined as a heat absorption peak intensity.

(2) Measurement of Molecular Weight of Wax Component

Measurement is performed by means of gel permeation chromatography (GPC) under the following conditions.

Device: GPC-150C (manufactured by Waters Corporation)

Column: GMH-MT 30 cm×2 (manufactured by Tosoh Corporation)

Temperature: 135° C.

Solvent: o-dichlorobenzene (added with 0.1% of IONOL)

Flow rate: 1.0 ml/min

Sample: 0.4 ml of a 0.15% sample is injected.

The measurement is performed under the above described conditions. Upon calculation of the molecular weight of the sample, a molecular weight calibration curve created from a monodisperse polystyrene standard sample is used. Furthermore, the molecular weight is calculated through polyethylene conversion by using a conversion equation obtained from a Mark-Houwink viscosity equation.

(3) Measurement of Molecular Weight Distribution of Tetrahydrofuran (THF) Soluble Component of Each of Toner and Low-Molecular Weight Polymer (Measurement of Weight Average Molecular Weight of Toner)

A specific measurement method for a THF soluble component of the toner by means of gel permeation chromatography (GPC) is as described below. After the toner has been extracted with a tetrahydrofuran (THF) solvent in advance for 20 hours by means of a Soxhlet extractor, THF is distilled away by using a rotary evaporator. The resultant is dissolved into an appropriate amount of THF, and the resultant solution is filtered through a solvent-resistant membrane filter having a pore diameter of 0.3 μm. The resultant is used as a measurement sample. The molecular weight distribution of the sample is measured by using a HLC-8120GPC manufactured by Tosoh Corporation with the aid of a column constitution obtained by coupling Shodex KF-801, 802, 803, 804, 805, 806, and 807 manufactured by Showa Denko K.K. and the analytical curve of a standard polystyrene resin (to be specific, TSK standard polystyrene manufactured by Tosoh Corporation was used). The weight average molecular weight (Mw) is calculated from the resultant molecular weight distribution.

(4) Measurement of Tetrahydrofuran (THF) Insoluble Component of Toner 1.0 g of the toner is weighed ($W_1$ g). The weighed toner is placed into extraction thimble (such as No. 86R manufactured by ADVANTEC), and the whole is subjected to a Soxhlet extractor and extracted by using 200 ml of THF as a solvent for 20 hours. After a soluble component extract with the solvent has been evaporated, the resultant is dried in a vacuum at 40° C. for several hours. Then, the amount of a THF-soluble resin component is weighed ($W_2$ g). The weight of a component except the resin component in the toner such as a pigment is denoted by ($W_3$ g). The content of the THF insoluble component can be determined from the following equation.

$$\text{The content of the } THF \text{ insoluble component } (\%) = \left[\frac{W_1 - (W_3 + W_2)}{(W_1 - W_3)}\right] \times 100 \qquad \text{Formula 1}$$

(5) Measurement of Weight Average Particle Diameter (D4) of Toner

An interface (manufactured by Nikkaki Bios Co., Ltd.) and a PC9801 personal computer (manufactured by NEC Corporation) for outputting a number distribution and a volume distribution are connected to a Coulter Multisizer (manufactured by Beckman Coulter, Inc), and the weight average particle diameter can be measured by means of the Coulter Multisizer. 1% aqueous solution of NaCl is prepared as an electrolyte with extra-pure sodium chloride. For example, an ISOTON R-II (manufactured by Coulter Scientific Japan, Co.) can be used. 100 to 150 ml of the electrolyte are added, and 2 to 20 mg of a measurement sample are added. The electrolyte into which the sample has been suspended is subjected to a dispersion treatment by using an ultrasonic dispersing device for about 1 to 3 minutes. The volume and number of toner particles each having a diameter of 2.0 μm or more are measured with the Coulter Multisizer by using a 100-μm aperture, and then the weight average particle diameter (D4) is determined.

EXAMPLES

Hereinafter, the present invention will be described more specifically by way of production examples and examples. However, these examples do not limit the present invention at all.

Production Example 1 of Toner 16.5 parts by mass of C.I. Pigment Blue 15:3 and 3.0 parts by mass of an aluminum 3,5-ditertiarybutylsalicylate compound [Bontron E88 (manufactured by Orient Chemical Industries, Ltd.)] were prepared for 100 parts by mass of a styrene monomer. They were introduced into an Attritor (manufactured by MITSUI MINING CO., LTD.), and were stirred by using zirconia beads each having a radius of 1.25 mm (140 parts by mass) at 200 rpm and 25° C. for 180 minutes. Thus, a master batch dispersion liquid 1 was prepared.

Meanwhile, 450 parts by mass of a 0.1-mol/l aqueous solution of $Na_3PO_4$ were charged into 710 parts by mass of ion-exchanged water, and the temperature of the mixture was increased to 60° C. After that, 67.7 parts by mass of a 1.0-mol/l aqueous solution of $CaCl_2$ were gradually added to the mixture, whereby an aqueous medium containing a calcium phosphate compound was obtained.

| | |
|---|---|
| Master batch dispersion liquid 1 | 40 parts by mass |
| Styrene monomer | 28 parts by mass |
| n-butyl acrylate monomer | 18 parts by mass |
| Low-molecular weight polystyrene (Mw = 3,000, Mn = 1,050, Tg = 55° C.) | 20 parts by mass |
| Hydrocarbon-based wax (Fischer-Tropsch wax, maximum heat absorption peak = 80° C., Mw = 750) | 9 parts by mass |

-continued

| | |
|---|---|
| Polyester resin (Polycondensation product of an adduct of bisphenol A with 2 mol of propylene oxide and terephthalic acid at a ratio of 1:1, Tg = 65° C., Mw = 10,000, Mn = 6,000) | 5 parts by mass |
| Divinylbenzene | 0.01 part by mass |

The temperature of the above formulation was increased to 65° C., and then the formulation was uniformly dissolved and dispersed by using a TK Homomixer (manufactured by Tokushu Kika Kogyo Co., Ltd.) at 5,000 rpm. 10 parts by mass of a 70% solution of a polymerization initiator 1,1,3,3-tetramethylbutylperoxy-2-ethylhexanoate in toluene were dissolved into the resultant, whereby a polymerizable monomer composition was prepared.

The above polymerizable monomer composition was loaded into the aqueous medium, and the whole was stirred in an $N_2$ atmosphere at 65° C. by using a TK Homomixer at 10,000 rpm for 10 minutes so that the polymerizable monomer composition was granulated. After that, the temperature of the resultant was increased to 67° C. while the resultant was stirred by using a paddle stirring blade. When the polymerization conversion rate of a polymerizable vinyl-based monomer reached 90%, a 0.1-mol/l aqueous solution of sodium hydroxide was added to adjust the pH of the aqueous dispersion medium to 9. Furthermore, the temperature of the resultant was increased to 80° C. at a rate of temperature increase of 40° C./h, followed by a reaction for 4 hours. After the completion of a polymerization reaction, the remaining monomer was distilled away under reduced pressure. After the resultant had been cooled, hydrochloric acid was added to adjust the pH of the resultant to 1.4, and a calcium phosphate salt was dissolved by stirring for 6 hours. After having been filtered and washed with water, toner particles (A) each having a cyan color were obtained with drying at 40° C. for 12 hours.

100 parts by mass of the toner particles were dry-mixed with 1.0 part by mass of a hydrophobic silica fine powder the surface of which had been treated with hexamethyldisilazane (number average primary particle diameter: 7 nm) and 0.15 part by mass of a rutile type titanium oxide fine powder (number average primary particle diameter: 30 nm) by using a Henschel mixer (manufactured by MITSUI MINING CO., LTD.) for 5 minutes, whereby a toner (A) of the present invention was obtained.

Production Example 2 of Toner

A toner (B) was obtained in the same manner as in <Production Example 1 of Toner> except that: the amount of low-molecular weight polystyrene (Mw=2,800, Mn=1,000, Tg=53° C.) to be added was changed to 10 parts by mass; and the amount of the styrene monomer to be added was changed to 38 parts by mass.

Production Example 3 of Toner

A toner (C) was obtained in the same manner as in <Production Example 1 of Toner> except that the amount of divinylbenzene to be added was changed to 0.05 part by mass.

Production Example 4 of Toner

A toner (D) was obtained in the same manner as in <Production Example 1 of Toner> except that: the amount of the styrene monomer to be added was changed to 23 parts by mass; and the amount of the n-butyl acrylate monomer to be added was changed to 23 parts by mass.

Production Example 5 of Toner

A toner (E) was obtained in the same manner as in <Production Example 1 of Toner> except that: the amount of divinylbenzene to be added was changed to 0.05 part by mass; and the amount of the 70% solution of the polymerization initiator 1,1,3,3-tetramethylbutylperoxy-2-ethylhexanoate in toluene to be added was changed to 7.0 parts by mass.

Production Example 6 of Toner

A toner (F) was obtained in the same manner as in <Production Example 1 of Toner> except that the amount of the 70% solution of the polymerization initiator 1,1,3,3-tetramethylbutylperoxy-2-ethylhexanoate in toluene was changed to 12 parts by mass.

Production Example 7 of Toner

A toner (G) was obtained in the same manner as in <Production Example 1 of Toner> except that: the amount of divinylbenzene to be added was changed to 0.05 part by mass; and the temperature at which stirring was performed by using a paddle stirring blade after granulation was changed to 65° C.

Production Example 8 of Toner

A toner (H) was obtained in the same manner as in <Production Example 1 of Toner> except that: no hydrocarbon-based wax was added; and 9 parts by mass of an ester wax (behenyl behenate: maximum heat absorption peak=75° C., Mw=700) were added.

Production Example 9 of Toner

A toner (I) was obtained in the same manner as in <Production Example 1 of Toner> except that the amount of hydrocarbon-based wax to be added was changed to 3 parts by mass.

Production Example 10 of Toner

A toner (J) was obtained in the same manner as in <Production Example 1 of Toner> except that the amount of hydrocarbon-based wax to be added was changed to 16 parts by mass.

Production Examples 11, 12, 13, and 14 of Toners

Toners (K), (L), (M), and (N) were each obtained in the same manner as in <Production Example 1 of Toner> except that the kind of the hydrocarbon-based wax was changed to a hydrocarbon-based wax having different physical properties as shown in Table 1.

Production Example 15 of Toner

A toner (O) was obtained in the same manner as in <Production Example 1 of Toner> except that: the amount of divinylbenzene to be added was changed to 0.05 part by mass; the amount of the 70% solution of 1,1,3,3-tetramethylbutylperoxy-2-ethylhexanoate in toluene was changed to 8 parts by mass; and the temperature at which stirring was performed by using a paddle stirring blade after granulation was changed to 65° C.

Production Example 16 of Toner

A toner (P) was obtained in the same manner as in <Production Example 1 of Toner> except that the amount of divinylbenzene to be added was changed to 0.10 part by mass.

Production Example 17 of Toner

A toner (Q) was obtained in the same manner as in <Production Example 1 of Toner> except that: the amount of ion-exchanged water was changed to 613 parts by mass; the amount of the 0.1-mol/l aqueous solution of $Na_3PO_4$ was changed to 534 parts by mass; and the amount of the 1.0-mol/l aqueous solution of $CaCl_2$ was changed to 80.4 parts by mass.

Production Example 18 of Toner

A toner (R) was obtained in the same manner as in <Production Example 1 of Toner> except that: the amount of ion-exchanged water was changed to 804 parts by mass; the amount of the 0.1-mol/l aqueous solution of $Na_3PO_4$ was changed to 369 parts by mass; and the amount of the 1.0-mol/l aqueous solution of $CaCl_2$ was changed to 55.0 parts by mass.

Production Example 19 of Toner

A toner (S) was obtained in the same manner as in <Production Example 1 of Toner> except that the low-molecular weight polystyrene was changed to a low-molecular weight polymer (styrene-n-butyl acrylate copolymer resin: copolymerization ratio 96:4, Mw=3,100, Mn=1,100, Tg=48° C.).

Production Example 20 of Toner

A toner (T) was obtained in the same manner as in <Production Example 1 of Toner> except that: the amount of the hydrocarbon-based wax to be added was changed to 5 parts by mass; and 4 parts by mass of an ester wax (behenyl behenate: maximum heat absorption peak=75° C., Mw=700) were added.

Production Example 21 of Toner

A toner (U) was obtained in the same manner as in <Production Example 1 of Toner> except that: the low-molecular weight polystyrene was changed to a low-molecular weight polymer (styrene-n-butyl acrylate copolymer resin: copolymerization ratio 96:4, Mw=3,100, Mn=1,100, Tg=48° C.); the amount of the low-molecular weight polymer to be added was changed to 5 parts by mass; and the amount of the styrene monomer was changed to 43 parts by mass.

Production Example 22 of Toner

A toner (V) was obtained in the same manner as in <Production Example 1 of Toner> except that: the low-molecular weight polystyrene was changed to a low-molecular weight polymer (styrene-n-butyl acrylate copolymer resin: copolymerization ratio 96:4, Mw=3,100, Mn=1,100, Tg=48° C.); the amount of the low-molecular weight polymer to be added was changed to 3 parts by mass; and the amount of the styrene monomer to be added was changed to 46 parts by mass; the amount of the hydrocarbon-based wax to be added was changed to 5 parts by mass; and 4 parts by mass of an ester wax (behenyl behenate: maximum heat absorption peak=75° C., Mw=700) were added.

Production Example 1 of Comparative Toner

A comparative toner (a) was obtained in the same manner as in <Production Example 1 of Toner> except that: the amount of the styrene monomer to be added was changed to 48 parts by mass; and no low-molecular weight polystyrene was added.

Production Example 2 of Comparative Toner

A comparative toner (b) was obtained in the same manner as in <Production Example 1 of Toner> except that no hydrocarbon-based wax was added.

Production Example 3 of Comparative Toner

A comparative toner (c) was obtained in the same manner as in <Production Example 1 of Toner> except that: divinylbenzene was not added; no hydrocarbon-based wax was added and 10 parts by mass of an ester wax (behenyl behenate: maximum heat absorption peak=75° C., Mw=700) were added; the amount of the 70% solution of 1,1,3,3-tetramethylbutylperoxy-2-ethylhexanoate in toluene was changed to 15 parts by mass; and the temperature at which stirring was performed by using a paddle stirring blade after granulation was changed to 70° C.

Production Example 4 of Comparative Toner

A comparative toner (d) was obtained in the same manner as in <Production Example 1 of Toner> except that: the amount of divinylbenzene to be added was changed to 0.5 part by mass; no hydrocarbon-based wax was added and 10 parts by mass of a polypropylene wax (maximum heat absorption peak=129° C., Mw=17,000) were added; the amount of the 70% solution of 1,1,3,3-tetramethylbutylperoxy-2-ethylhexanoate in toluene was changed to 6 parts by mass; a granulation temperature was changed to 60° C.; and the temperature at which stirring was performed by using a paddle stirring blade after granulation was changed to 60° C.

Production Example 5 of Comparative Toner

The following materials were mixed in advance, and the mixture was melted and kneaded by using a biaxial extruder. The kneaded product was cooled, and was then coarsely pulverized by using a hammer mill. The coarsely pulverized product was finely pulverized by using a jet mill. The resultant finely pulverized product was classified, whereby toner particles (e) were obtained.

| | |
|---|---|
| Binder resin<br>[Styrene-n-butyl acrylate copolymer resin<br>(Mw = 30,000, Tg = 62° C.)] | 100 parts by mass |
| C.I. Pigment Blue 15:3 | 5 parts by mass |
| Aluminum 3,5-ditertiarybutylsalicylate compound<br>[manufactured by Orient Chemical<br>Industries, Ltd.: Bontron E88] | 3 parts by mass |
| Ester wax<br>(Behenyl behenate, maximum heat absorption<br>peak = 75° C., Mw = 700) | 10 parts by mass |

After the above-mentioned toner particles (e) had been obtained, a comparative toner (e) was obtained in the same manner as in <Production Example 1 of Toner>.

Table 1 and Table 2 show the main contents of the formulation of each of the above-mentioned production examples of toners and production examples of comparative toners, and the physical properties of the toners.

TABLE 1

| | Toner No. | Rheological properties of toner | | | | |
|---|---|---|---|---|---|---|
| | | $G'_{110}$ [dN/m$^2$] | $G'_{150}$ [dN/m$^2$] | $\Delta T_A$ [° C.] | To [° C.] | Point of intersection of straight lines B and C |
| Production Example 1 of Toner | A | $1.57 \times 10^5$ | $7.30 \times 10^3$ | 12 | 76 | 110° C. |
| Production Example 2 of Toner | B | $1.62 \times 10^5$ | $1.02 \times 10^4$ | 13 | 75 | 109° C. |
| Production Example 3 of Toner | C | $1.31 \times 10^5$ | $1.90 \times 10^4$ | 11 | 77 | 108° C. |
| Production Example 4 of Toner | D | $1.75 \times 10^5$ | $9.90 \times 10^3$ | 15 | 78 | 113° C. |
| Production Example 5 of Toner | E | $1.20 \times 10^5$ | $1.80 \times 10^4$ | 14 | 71 | 107° C. |
| Production Example 6 of Toner | F | $1.27 \times 10^5$ | $4.72 \times 10^3$ | 13 | 78 | 112° C. |
| Production Example 7 of Toner | G | $9.99 \times 10^4$ | $9.04 \times 10^3$ | 12 | 76 | 111° C. |
| Production Example 8 of Toner | H | $1.12 \times 10^5$ | $9.87 \times 10^3$ | 11 | 75 | 105° C. |
| Production Example 9 of Toner | I | $1.60 \times 10^5$ | $7.79 \times 10^3$ | 15 | 77 | 109° C. |
| Production Example 10 of Toner | J | $1.42 \times 10^5$ | $6.94 \times 10^3$ | 13 | 76 | 110° C. |
| Production Example 11 of Toner | K | $1.59 \times 10^5$ | $9.18 \times 10^3$ | 10 | 76 | 111° C. |
| Production Example 12 of Toner | L | $1.72 \times 10^5$ | $9.13 \times 10^3$ | 12 | 76 | 110° C. |
| Production Example 13 of Toner | M | $9.80 \times 10^4$ | $6.70 \times 10^3$ | 13 | 76 | 115° C. |
| Production Example 14 of Toner | N | $1.10 \times 10^5$ | $9.87 \times 10^3$ | 12 | 76 | 112° C. |
| Production Example 15 of Toner | O | $1.80 \times 10^5$ | $1.10 \times 10^4$ | 11 | 70 | 111° C. |
| Production Example 16 of Toner | P | $1.61 \times 10^5$ | $7.32 \times 10^3$ | 16 | 77 | 110° C. |
| Production Example 17 of Toner | Q | $1.78 \times 10^5$ | $9.36 \times 10^3$ | 15 | 76 | 107° C. |
| Production Example 18 of Toner | R | $1.41 \times 10^5$ | $6.38 \times 10^3$ | 12 | 76 | 106° C. |
| Production Example 19 of Toner | S | $1.02 \times 10^5$ | $6.46 \times 10^3$ | 11 | 79 | 109° C. |
| Production Example 20 of Toner | T | $1.04 \times 10^5$ | $9.80 \times 10^3$ | 11 | 76 | 110° C. |
| Production Example 21 of Toner | U | $9.80 \times 10^4$ | $4.50 \times 10^3$ | 16 | 77 | 118° C. |
| Production Example 22 of Toner | V | $1.20 \times 10^5$ | $5.10 \times 10^3$ | 15 | 80 | 116° C. |
| Production Example 1 of Comparative Toner | a | $1.69 \times 10^5$ | $8.90 \times 10^3$ | 19 | 76 | 133° C. |
| Production Example 2 of Comparative Toner | b | $1.72 \times 10^5$ | $1.09 \times 10^4$ | — | 75 | — |
| Production Example 3 of Comparative Toner | c | $2.10 \times 10^5$ | $2.97 \times 10^3$ | — | 80 | — |
| Production Example 4 of Comparative Toner | d | $6.60 \times 10^4$ | $2.36 \times 10^4$ | 13 | 69 | — |
| Production Example 5 of Comparative Toner | e | $2.98 \times 10^5$ | $2.96 \times 10^4$ | — | 68 | — |

| | Toner | Rheological properties of toner | | | | | | | | |
|---|---|---|---|---|---|---|---|---|---|---|
| | | P0 | | P1 | | | | | | |
| | No. | $T_{P0}$ | $\tan\delta_{P0}$ | $T_{P1}$ | $\tan\delta_{P1}$ | $\tan\delta_{170}$ | $\tan\delta_{P1} - \tan\delta_{170}$ | $G'_{80}/G'_{100}$ | $G'_{100}/G'_{120}$ | $G'_{120}/G'_{150}$ |
| Production Example 1 of Toner | A | 80° C. | 2.13 | 124° C. | 2.03 | 1.00 | 1.03 | 22 | 12 | 7 |
| Production Example 2 of Toner | B | 81° C. | 2.26 | 129° C. | 2.31 | 1.53 | 0.78 | 25 | 15 | 11 |
| Production Example 3 of Toner | C | 81° C. | 2.29 | 126° C. | 1.80 | 1.07 | 0.73 | 21 | 11 | 2 |
| Production Example 4 of Toner | D | 77° C. | 1.62 | 117° C. | 1.73 | 0.83 | 0.90 | 22 | 21 | 4 |
| Production Example 5 of Toner | E | 82° C. | 2.26 | 129° C. | 2.31 | 1.53 | 0.78 | 28 | 4 | 4 |
| Production Example 6 of Toner | F | 79° C. | 2.41 | 125° C. | 3.10 | 1.52 | 1.58 | 31 | 10 | 7 |
| Production Example 7 of Toner | G | 82° C. | 2.21 | 126° C. | 2.31 | 1.52 | 0.79 | 9 | 6 | 4 |
| Production Example 8 of Toner | H | 79° C. | 2.44 | 127° C. | 2.46 | 1.04 | 1.42 | 18 | 9 | 8 |
| Production Example 9 of Toner | I | 81° C. | 2.22 | 123° C. | 2.39 | 1.23 | 1.16 | 17 | 10 | 8 |
| Production Example 10 of Toner | J | 77° C. | 2.09 | 121° C. | 2.78 | 1.27 | 1.51 | 20 | 11 | 7 |
| Production Example 11 of Toner | K | 76° C. | 2.26 | 125° C. | 2.26 | 1.26 | 1.00 | 21 | 12 | 6 |
| Production Example 12 of Toner | L | 81° C. | 2.36 | 127° C. | 2.69 | 1.37 | 1.32 | 17 | 9 | 8 |
| Production Example 13 of Toner | M | 76° C. | 2.26 | 125° C. | 2.26 | 1.26 | 1.00 | 23 | 9 | 8 |
| Production Example 14 of Toner | N | 79° C. | 2.44 | 127° C. | 2.46 | 1.04 | 1.42 | 20 | 11 | 7 |
| Production Example 15 of Toner | O | 82° C. | 2.26 | 129° C. | 2.31 | 1.53 | 0.78 | 12 | 6 | 4 |
| Production Example 16 of Toner | P | 80° C. | 1.62 | 117° C. | 1.73 | 0.83 | 0.90 | 20 | 7 | 4 |
| Production Example 17 of Toner | Q | 81° C. | 2.29 | 126° C. | 1.80 | 1.07 | 0.73 | 18 | 9 | 6 |
| Production Example 18 of Toner | R | 79° C. | 2.09 | 124° C. | 1.99 | 1.07 | 0.92 | 21 | 10 | 6 |
| Production Example 19 of Toner | S | 77° C. | 1.62 | 117° C. | 1.73 | 0.83 | 0.90 | 11 | 6 | 6 |
| Production Example 20 of Toner | T | 78° C. | 2.07 | 121° C. | 2.36 | 1.23 | 1.13 | 12 | 7 | 4 |
| Production Example 21 of Toner | U | 80° C. | 2.31 | 134° C. | 2.01 | 1.66 | 0.35 | 25 | 12 | 9 |
| Production Example 22 of Toner | V | 79° C. | 2.40 | 140° C. | 3.75 | 3.20 | 0.55 | 26 | 10 | 8 |
| Production Example 1 of Comparative Toner | a | 81° C. | 2.48 | 134° C. | 2.09 | 1.66 | 0.43 | 27 | 12 | 10 |
| Production Example 2 of Comparative Toner | b | 82° C. | 2.22 | 125° C. | 2.10 | 1.56 | 0.54 | 12 | 6 | 5 |
| Production Example 3 of Comparative Toner | c | 66° C. | 2.41 | 119° C. | 1.99 | 1.36 | 0.63 | 10 | 11 | 7 |
| Production Example 4 of Comparative Toner | d | 86° C. | 2.47 | 139° C. | 2.30 | 1.60 | 0.70 | 15 | 9 | 2 |
| Production Example 5 of Comparative Toner | e | 84° C. | 2.10 | 134° C. | 2.31 | 2.02 | 0.29 | 13 | 11 | 11 |

TABLE 2

| | Toner No. | Wax | | | |
|---|---|---|---|---|---|
| | | Kind | Content (parts by mass) | maximum heat absorption peak | Mw |
| Production Example 1 of Toner | A | Fischer-Tropsch wax | 9 | 80° C. | 750 |
| Production Example 2 of Toner | B | Fischer-Tropsch wax | 9 | 80° C. | 750 |

TABLE 2-continued

| | | | | | |
|---|---|---|---|---|---|
| Production Example 3 of Toner | C | Fischer-Tropsch wax | 9 | 80° C. | 750 |
| Production Example 4 of Toner | D | Fischer-Tropsch wax | 9 | 80° C. | 750 |
| Production Example 5 of Toner | E | Fischer-Tropsch wax | 9 | 80° C. | 750 |
| Production Example 6 of Toner | F | Fischer-Tropsch wax | 9 | 80° C. | 750 |
| Production Example 7 of Toner | G | Fischer-Tropsch wax | 9 | 80° C. | 750 |
| Production Example 8 of Toner | H | Ester wax | 9 | 75° C. | 700 |
| Production Example 9 of Toner | I | Fischer-Tropsch wax | 3 | 80° C. | 750 |
| Production Example 10 of Toner | J | Fischer-Tropsch wax | 16 | 80° C. | 750 |
| Production Example 11 of Toner | K | Fischer-Tropsch wax | 9 | 58° C. | 310 |
| Production Example 12 of Toner | L | Polypropylene wax | 9 | 115° C. | 3900 |
| Production Example 13 of Toner | M | Fischer-Tropsch wax | 9 | 70° C. | 280 |
| Production Example 14 of Toner | N | Fischer-Tropsch wax | 9 | 98° C. | 4200 |
| Production Example 15 of Toner | O | Fischer-Tropsch wax | 9 | 80° C. | 750 |
| Production Example 16 of Toner | P | Fischer-Tropsch wax | 9 | 80° C. | 750 |
| Production Example 17 of Toner | Q | Fischer-Tropsch wax | 9 | 80° C. | 750 |
| Production Example 18 of Toner | R | Fischer-Tropsch wax | 9 | 80° C. | 750 |
| Production Example 19 of Toner | S | Fischer-Tropsch wax | 9 | 80° C. | 750 |
| Production Example 20 of Toner | T | Fischer-Tropsch wax | 5 | 80° C. | 750 |
| | | Ester wax | 4 | 75° C. | 700 |
| Production Example 21 of Toner | U | Fischer-Tropsch wax | 9 | 80° C. | 750 |
| Production Example 22 of Toner | V | Fischer-Tropsch wax | 5 | 80° C. | 750 |
| | | Ester wax | 4 | 75° C. | 700 |
| Production Example 1 of Comparative Toner | a | Fischer-Tropsch wax | 9 | 80° C. | 750 |
| Production Example 2 of Comparative Toner | b | — | — | — | — |
| Production Example 3 of Comparative Toner | c | Ester wax | 10 | 75° C. | 700 |
| Production Example 4 of Comparative Toner | d | Polypropylene wax | 10 | 129° C. | 17,000 |
| Production Example 5 of Comparative Toner | e | Ester wax | 10 | 75° C. | 700 |

| | Toner No. | Mw of low-molecular weight polymer | Mw of toner THF soluble component | Toner THF insoluble component | weight average particle diameter D4 (μm) |
|---|---|---|---|---|---|
| Production Example 1 of Toner | A | 3,000 | 37,000 | 2.5 mass % | 6.8 |
| Production Example 2 of Toner | B | 2,800 | 41,000 | 4.1 mass % | 6.9 |
| Production Example 3 of Toner | C | 3,000 | 45,000 | 4.5 mass % | 6.6 |
| Production Example 4 of Toner | D | 3,000 | 22,000 | 1.7 mass % | 6.7 |
| Production Example 5 of Toner | E | 3,000 | 53,000 | 4.8 mass % | 6.7 |
| Production Example 6 of Toner | F | 3,000 | 28,000 | 3.1 mass % | 6.8 |
| Production Example 7 of Toner | G | 3,000 | 63,000 | 4.9 mass % | 6.8 |
| Production Example 8 of Toner | H | 3,000 | 22,000 | 1.7 mass % | 6.7 |
| Production Example 9 of Toner | I | 3,000 | 31,000 | 3.7 mass % | 6.9 |
| Production Example 10 of Toner | J | 3,000 | 33,000 | 3.9 mass % | 7.1 |
| Production Example 11 of Toner | K | 3,000 | 23,000 | 2.5 mass % | 6.8 |
| Production Example 12 of Toner | L | 3,000 | 37,000 | 4.3 mass % | 7.2 |
| Production Example 13 of Toner | M | 3,000 | 29,000 | 3.1 mass % | 6.9 |
| Production Example 14 of Toner | N | 3,000 | 55,000 | 4.3 mass % | 7.0 |
| Production Example 15 of Toner | O | 3,000 | 91,000 | 4.8 mass % | 6.9 |
| Production Example 16 of Toner | P | 3,000 | 82,000 | 6.0 mass % | 6.9 |
| Production Example 17 of Toner | Q | 3,000 | 35,000 | 2.8 mass % | 3.9 |
| Production Example 18 of Toner | R | 3,000 | 40,000 | 2.4 mass % | 9.2 |
| Production Example 19 of Toner | S | 3,100 | 19,800 | 2.9 mass % | 5.8 |
| Production Example 20 of Toner | T | 3,000 | 32,000 | 3.3 mass % | 6.8 |
| Production Example 21 of Toner | U | 3,100 | 30,000 | 2.9 mass % | 6.7 |
| Production Example 22 of Toner | V | 3,100 | 29,000 | 2.5 mass % | 6.8 |
| Production Example 1 of Comparative Toner | a | — | 23,000 | 2.5 mass % | 7.1 |
| Production Example 2 of Comparative Toner | b | 3,000 | 39,000 | 3.9 mass % | 5.5 |
| Production Example 3 of Comparative Toner | c | 3,000 | 20,000 | 1.1 mass % | 5.8 |
| Production Example 4 of Comparative Toner | d | 3,000 | 56,000 | 25 mass % | 7.3 |
| Production Example 5 of Comparative Toner | e | — | 110,000 | 23 mass % | 6.9 |

Example 1

The toner (A) was evaluated for each of items (1) to (12) to be described later.

Table 3 shows the results. A duration test was performed, and evaluation for a state upon completion of duration was performed. As a result, an image density did not reduce, and was identical to an initial image density. In addition, no image fogging occurred. The contamination of each of a charging imparting member and a regulating member was not observed at all, no image failure occurred till the completion of duration evaluation, and a beautiful image was obtained.

In each of Examples 2 to 22 and Comparative Examples 1 to 5, evaluation was performed in the same manner as in Example 1 except that the toner to be used was changed to each of the toners (B) to (V) and the comparative toners (a) to (e). Table 3 shows the results of those examples and comparative examples together with the results of Example 1 described above.

Hereinafter, a specific evaluation method will be shown.

An LBP-2510 (manufactured by Canon Inc.) was used as an evaluation device, and image evaluation was performed in each environment. The evaluation was performed by: filling a cartridge with 190 g of each toner described in Table 1; mounting the cartridge on a cyan station; and mounting a dummy cartridge on any other station.

(1) Low-Temperature Fixing Ability

Evaluation was performed by using Xx 64 g/m$^2$ paper in a low-temperature, low-humidity (L/L; 15° C., 10% RH) environment. Nine of 5-cm square solid images were outputted on A4 paper. The toner mounting amount of an unfixed image at this time was 0.6 mg/cm$^2$. The image was rubbed five times with lens-cleaning paper to which a load of 4.9 kPa was applied. The evaluation was performed with the temperature at which a density reduced by 20% or more defined as a fixation minimum temperature.

A: The fixation minimum temperature is lower than 145° C.

B: The fixation minimum temperature is 145° C. or higher and lower than 155° C.

C: The fixation minimum temperature is 155° C. or higher and lower than 165° C.

D: The fixation minimum temperature is 165° C. or higher and lower than 175° C.

E: The fixation minimum temperature is 175° C. or higher.

(2) Offset Resistance after Duration

Images each having a printing ratio of 2% were printed out up to 5,000 sheets by using Xx 75 g/m$^2$ paper in a normal-temperature, normal-humidity (N/N; 23.5° C., 60% RH) environment. After that, an image, in which the entire region from the tip of the image to 5 cm when vertically placed on A4 paper had a half tone with an image density of 0.5 and the other region was solid white, was copied on each of both surfaces of Xx 64 g/m$^2$ paper. The level of an offset appearing in a white ground portion at this time was visually observed.

A: No offset occurs.

B: A thin offset occurs at an end portion except a part transferred while being vertically placed on A4 paper.

C: A slight offset occurs at an end portion except a part transferred while being vertically placed on A4 paper.

D: An offset occurs over the entire region in a longitudinal direction.

E: An offset occurs over the entire region in a longitudinal direction even in the first surface.

(3) Image Gloss

A solid image having a toner mounting amount of 0.5 mg/cm$^2$ was created by using Xx 75 g/m$^2$ paper in a normal-temperature, normal-humidity (N/N; 23.5° C., 60% RH) environment. An image gloss at a measurement optical portion angle of 75° was measured by using a "PG-3D" (manufactured by NIPPON DENSHOKU).

A: The image gloss is 25 or more.

B: The image gloss is 20 or more and less than 25.

C: The image gloss is 18 or more and less than 20.

D: The image gloss is 15 or more and less than 18.

E: The image gloss is less than 15.

(4) OHP Transparency

An image on an OHP sheet "CG3700" (manufactured by 3M) was turned into a transmission image by using an OHP "9550" (manufactured by 3M) in a normal-temperature, normal-humidity (N/N; 23.5° C., 60% RH) environment. An image projected onto a white wall surface was visually evaluated on the basis of five stages as described below.

A: Transparency is significantly high and good.

B: Transparency is good.

C: Slight somberness is observed.

D: Considerable somberness is observed.

E: Remarkable somberness occurs.

(5) Coloring Power

Several kinds of solid images having different toner mounting amounts in the range of 0.1 mg/cm$^2$ to 1.0 mg/cm$^2$ were created by using Xx 75 g/m$^2$ paper in a normal-temperature, normal-humidity (N/N; 23.5° C., 60% RH) environment. The image density of each of those images was measured by using a "Macbeth reflection densitometer RD918" (manufactured by GretagMacbeth). After a relationship between the amount of toner on transfer paper and an image density had been determined, relative evaluation for coloring power was performed with an image density corresponding to the case where a toner mounting amount on the transfer paper was 0.5 mg/cm$^2$.

A: The image density is 1.40 or more.

B: The image density is 1.30 or more and less than 1.40.

C: The image density is 1.20 or more and less than 1.30.

D: The image density is 1.10 or more and less than 1.20.

E: The image density is less than 1.10.

(6) Image Density

In an image output test in which images each having a printing ratio of 2% were printed out on up to 10,000 sheets of Xx 75 g/m$^2$ paper in each of a high-temperature, high-humidity (H/H; 30° C., 80% RH) environment and of a low-temperature, low-humidity (L/L; 15° C., 10% RH) environment, a solid image was outputted upon completion of duration evaluation, and the density of the image was measured for evaluation. It should be noted that a relative density for an image having a white ground part with an original density of 0.00 was measured as an image density by using a "Macbeth reflection densitometer RD918" (manufactured by Gretag-Macbeth).

A: The image density is 1.40 or more.

B: The image density is 1.30 or more and less than 1.40.

C: The image density is 1.20 or more and less than 1.30.

D: The image density is 1.10 or more and less than 1.20.

E: The image density is less than 1.10.

(7) Image Fogging

In an image output test in which images each having a printing ratio of 2% were printed out on up to 10,000 sheets of Xx 75 g/m$^2$ paper in each of a high-temperature, high-humidity (H/H; 30° C., 80% RH) environment and of a low-temperature, low-humidity (L/L; 15° C., 10% RH) environment, an image having a white ground part was outputted upon completion of duration evaluation. Then, a fogging density (%) (=Dr (%)−Ds (%)) was calculated from a difference between the degree of whiteness of the white ground part of the printed-out image (reflectivity Ds(%)) and the degree of whiteness of transfer paper (average reflectivity Dr (%)) measured by using a "REFLECTMETER MODEL TC-6DS" (manufactured by Tokyo Denshoku), and evaluation for image fogging upon completion of the duration evaluation was performed. An amberlite filter was used as a filter.

A: The fogging density is less than 0.5%.

B: The fogging density is 0.5% or more and less than 1.0%.

C: The fogging density is 1.0% or more and less than 1.5%.

D: The fogging density is 1.5% or more and less than 5.0%.

E: The fogging density is 5.0% or more.

(8) Scattering

After a duration test in a high-temperature, high-humidity (H/H; 30° C., 80% RH) environment, evaluation for image quality (comprehensive evaluation of a 5-point character, a line image, and a solid image) was performed with the eyes and with a loupe. The evaluation criteria are as described below.

A: No scattering occurs, a line image and a character image are clear, and a solid image is uniform and good.

B: Slight scattering is observed with the loupe, but is not problematic at all when observed with the eyes, and a solid image is uniform and good.

C: A slightly scattering part is observed with the eyes in each of a line image and a character image, but is not at a level where the part causes a problem in practical use.

D: A large amount of a scattering part is observed with the eyes in each of a line image and a character image.

E: The occurrence of remarkable scattering is observed with the eyes in each of a line image and a character image.

(9) Contamination of Charging Member (=Charging Roller) for Photosensitive Member In an image output test in which images each having a printing ratio of 2% were printed out on up to 10,000 sheets of Xx 75 g/m$^2$ paper in a low-temperature, low-humidity (L/L; 15° C., 10% RH) environment, a charging member (=a charging roller) for a photosensitive member was observed after the completion of duration evaluation.

A: The charging member is not contaminated at all.

B: The charging member is slightly contaminated, but no image failure occurs.

C: The charging member is contaminated, and a slight image failure also occurs.

D: The contamination of the charging member is conspicuous, and an image failure is also conspicuous.

E: The contamination of the charging member is severe, and a remarkable image failure also occurs.

(10) Contamination of Regulating Member (=Developing Blade)

In an image output test in which images each having a printing ratio of 2% were printed out on up to 10,000 sheets of Xx 75 g/m$^2$ paper in a high-temperature, high-humidity (H/H; 30° C., 80% RH) environment, a regulating member was observed after the completion of duration evaluation.

A: The regulating member is not contaminated at all.

B: The regulating member is slightly contaminated, but no image failure occurs.

C: The regulating member is contaminated, and a slight image failure also occurs.

D: The contamination of the regulating member is conspicuous, and an image failure is also conspicuous.

E: The contamination of the regulating member is severe, and a remarkable image failure also occurs.

(11) Fixing Roller Winding Property

In a high-temperature, high-humidity (H/H; 30° C., 80% RH) environment, fixation winding was observed at an initial stage of a duration test. A solid image having a toner mounting amount of 1.1 mg/cm$^2$ was mounted on EN100 (64 g/m$^2$ paper) completely moisture-adjusted paper from a position distant from the tip of transfer paper by 1 mm, whereby an unfixed image was obtained. The image was fixed by using a fixing device IRC3200. At this time, a fixation temperature was reduced from 175° C. in decrements of 5° C. The temperature at which the transfer paper wound around a fixing roller was defined as a fixing roller winding temperature.

A: The fixing roller winding temperature is 155° C. or lower.

B: The fixing roller winding temperature is higher than 155° C. and 160° C. or lower.

C: The fixing roller winding temperature is higher than 160° C. and 165° C. or lower.

D: The fixing roller winding temperature is higher than 165° C. and 170° C. or lower.

E: The fixing roller winding temperature is higher than 170° C.

(12) Blocking Test (Storage Stability Test)

10 g of toner were placed in a 50-cc polycup. The state of the toner in the polycup had been left in a thermostat bath at 53° C. for 72 hours was visually judged as described below.

A: No blocking occurs, and the state is substantially identical to an initial state.

B: The toner very slightly aggregates, but the aggregate can be collapsed by rotating the polycup, and the aggregate causes no particular problem.

C: The toner slightly aggregates, but the aggregate can be collapsed, and disentangled by hand.

D: The aggregation of the toner is severe.

E: The toner is solidified.

TABLE 3

| | Toner No. | Low-temperature fixing ability | Offset resistance | Image gloss | OHP transparency | Coloring power |
|---|---|---|---|---|---|---|
| Example 1 | A | A | A | A | A | A |
| Example 2 | B | A | B | A | A | A |
| Example 3 | C | C | A | B | A | A |
| Example 4 | D | A | A | A | A | A |
| Example 5 | E | C | A | B | A | A |
| Example 6 | F | A | B | A | A | A |
| Example 7 | G | B | A | A | A | A |
| Example 8 | H | A | B | A | A | A |
| Example 9 | I | B | B | B | B | A |
| Example 10 | J | B | B | B | B | B |
| Example 11 | K | A | C | A | A | A |
| Example 12 | L | C | B | B | B | B |
| Example 13 | M | B | C | B | B | B |
| Example 14 | N | B | B | B | C | B |
| Example 15 | O | B | B | C | C | C |
| Example 16 | P | B | B | C | C | B |
| Example 17 | Q | A | B | B | B | A |
| Example 18 | R | A | A | A | A | A |
| Example 19 | S | A | A | A | A | A |
| Example 20 | T | A | A | A | A | A |
| Example 21 | U | A | C | A | A | A |
| Example 22 | V | A | C | A | A | A |
| Comparative Example 1 | a | B | D | B | B | B |
| Comparative Example 2 | b | E | E | E | E | D |
| Comparative Example 3 | c | A | C | A | A | B |
| Comparative Example 4 | d | E | D | E | D | B |
| Comparative Example 5 | e | E | E | E | E | E |

| | Toner | Image density | | Image fogging | | |
|---|---|---|---|---|---|---|
| | No. | H/H | L/L | H/H | L/L | Scattering |
| Example 1 | A | A | A | A | A | A |
| Example 2 | B | A | A | A | A | A |

TABLE 3-continued

| | | | | | | |
|---|---|---|---|---|---|---|
| Example 3 | C | A | A | A | A | A |
| Example 4 | D | A | A | A | B | A |
| Example 5 | E | A | A | B | A | A |
| Example 6 | F | A | A | A | B | A |
| Example 7 | G | A | A | B | B | A |
| Example 8 | H | A | A | A | A | A |
| Example 9 | I | A | A | A | A | A |
| Example 10 | J | A | B | B | C | B |
| Example 11 | K | B | A | C | B | B |
| Example 12 | L | A | A | B | B | B |
| Example 13 | M | B | B | B | B | B |
| Example 14 | N | A | B | A | B | B |
| Example 15 | O | B | A | B | B | A |
| Example 16 | P | A | A | B | B | B |
| Example 17 | Q | B | B | C | C | B |
| Example 18 | R | A | A | B | B | C |
| Example 19 | S | A | A | B | A | A |
| Example 20 | T | A | A | A | B | A |
| Example 21 | U | A | B | A | B | A |
| Example 22 | V | A | B | A | B | A |
| Comparative Example 1 | a | B | B | B | B | A |
| Comparative Example 2 | b | D | D | C | C | B |
| Comparative Example 3 | c | E | D | E | D | B |
| Comparative Example 4 | d | E | E | E | E | B |
| Comparative Example 5 | e | E | E | E | E | C |

| | Toner No. | Contamination of Charging roller | Contamination of developing blade | Winding property | Blocking |
|---|---|---|---|---|---|
| Example 1 | A | A | A | A | A |
| Example 2 | B | A | B | A | A |
| Example 3 | C | A | A | A | A |
| Example 4 | D | B | B | A | B |
| Example 5 | E | A | B | A | A |
| Example 6 | F | B | B | A | A |
| Example 7 | G | B | B | A | B |
| Example 8 | H | B | B | A | B |
| Example 9 | I | B | A | C | A |
| Example 10 | J | B | C | A | B |
| Example 11 | K | B | C | A | C |
| Example 12 | L | B | B | B | B |
| Example 13 | M | B | C | A | B |
| Example 14 | N | B | A | A | B |
| Example 15 | O | B | B | A | B |
| Example 16 | P | B | A | A | B |
| Example 17 | Q | C | B | A | B |
| Example 18 | R | A | A | A | A |
| Example 19 | S | B | C | A | B |
| Example 20 | T | B | B | A | A |
| Example 21 | U | B | B | B | B |
| Example 22 | V | C | B | B | B |
| Comparative Example 1 | a | B | B | A | B |
| Comparative Example 2 | b | C | C | E | A |
| Comparative Example 3 | c | C | E | A | D |
| Comparative Example 4 | d | E | E | E | A |
| Comparative Example 5 | e | E | E | E | C |

The invention claimed is:

1. A non-magnetic toner comprising:

toner particles; and an inorganic fine powder, wherein:

each of the toner particles contains at least a binder resin, a colorant, a polyester resin, and a wax component;

the binder resin is a styrene-acrylic copolymer or a styrene-methacrylic copolymer;

a storage elastic modulus at 110° C. ($G'_{110}$) of the non-magnetic toner is in a range of $2.00\times10^4$ to $2.00\times10^5$ $dN/m^2$;

a storage elastic modulus at 150° C. ($G'_{150}$) of the non-magnetic toner is in a range of $3.00\times10^3$ to $2.00\times10^4$ $dN/m^2$;

in a differential curve obtained by differentiating a temperature-storage elastic modulus curve in which an axis of abscissa indicates a temperature and an axis of ordinate indicates a common logarithm LogG' of a storage elastic modulus G' with respect to a temperature, when a temperature at which the differential curve shows a minimum value in a temperature region of 60 to 130° C. is denoted by $T_0$, a straight line having a largest gradient out of straight lines each of which is drawn to connect a point on the differential curve at a temperature of $T_0$+"a" (° C.) and a point on the differential curve at a temperature of ($T_0$+"a")+1 (° C.) [where "a" represents an integer of 0 to 9] is denoted by A, a straight line having a smallest gradient out of straight lines each of which is drawn to connect a point on the differential curve at a temperature of $T_0$+"b" (° C.) and a point on the differential curve at a temperature of ($T_0$+"b")+10 (° C.)

[where "b" represents an integer of 0 or more] is denoted by B, and a straight line having a largest gradient out of straight lines each of which is drawn to connect a point on the differential curve at a temperature of $T_0$+"c" (° C.) and a point on the differential curve at a temperature of ($T_0$+"c")+10 (° C.)

[where "c" represents an integer larger than "a value "b" providing the straight line B"] is denoted by C, a temperature width $\Delta T_A$ from $T_0$ to a point of intersection of the straight lines A and B satisfies a relationship of 1° C.≦$\Delta T_A$≦20° C.;

a temperature $T_{BC}$ at which a point of intersection of the straight lines B and C is present satisfies a relationship of 100° C.≦$T_{BC}$≦120° C.;

the toner particles are obtained by dispersing a polymerizable monomer composition containing vinyl-based polymerizable monomers, divinylbenzene, the colorant, the wax component, the polyester resin, and a low-molecular weight polymer into an aqueous medium, granulating the dispersed polymerizable monomer composition, and polymerizing the vinyl-based polymerizable monomers and divinylbenzene in granulated particles;

the low-molecular weight polymer has a weight average molecular weight (Mw) measured by means of gel permeation chromatography (GPC) in a range of 2000 to 5000; and the wax component has a maximum heat absorption peak in a temperature range of 60 to 120° C. measured by using a differential scanning calorimeter (DSC).

2. A non-magnetic toner according to claim 1, wherein:

a loss tangent tan δ represented as a ratio of the loss elastic modulus G" of the non-magnetic toner to a storage elastic modulus G' of the non-magnetic toner (G"/G') has local maximal values (P0 and P1) in a range of 68 to 85° C. and a range of 110 to 135° C., respectively; and a difference between a local maximal value tan $\delta_{p1}$ of the loss tangent present in the range of 110 to 135° C. and a loss tangent tan $\delta_{170}$ at 170° C. is 0.60 or more.

3. A non-magnetic toner according to claim 1, wherein a ratio of a storage elastic modulus at 80° C. ($G'_{80}$) of the non-magnetic toner to a storage elastic modulus at 100° C. ($G'_{100}$) of the non-magnetic toner ($G'_{80}/G'_{100}$) is in a range of 10 to 30.

4. A non-magnetic toner according to claim 1, wherein a ratio of a storage elastic modulus at 100° C. ($G'_{100}$) of the non-magnetic toner to a storage elastic modulus at 120° C. ($G'_{120}$) of the non-magnetic toner ($G'_{100}/G'_{120}$) is in a range of 5 to 30.

5. A non-magnetic toner according to claim 1, wherein a ratio of a storage elastic modulus at 120° C. ($G'_{120}$) of the non-magnetic toner to a storage elastic modulus at 150° C. ($G'_{150}$) of the non-magnetic toner ($G'_{120}/G'_{150}$) is in a range of 3 to 10.

6. A non-magnetic toner according to claim 1, wherein the wax component contains a hydrocarbon based wax, and a content of the wax component is 4 to 15 parts by mass with respect to 100 parts by mass of the binder resin.

7. A non-magnetic toner according to claim 1, wherein a weight average molecular weight (Mw) of the wax component measured by means of gel permeation chromatography (GPC) is in a range of 300 to 4,000.

8. A non-magnetic toner according to claim 1, wherein a weight average molecular weight (Mw) of the non-magnetic toner measured by means of gel permeation chromatography (GPC) of tetrahydrofuran (THF) soluble component is in a range of 15,000 to 90,000.

9. A non-magnetic toner according to claim 1, wherein a content of tetrahydrofuran (THF) insoluble component in a resin component in the non-magnetic toner is 5.0 mass % or less.

10. A non-magnetic toner according to claim 1, wherein a weight average particle diameter (D4) of the non-magnetic toner is in a range of 4.0 to 9.0 μm.

11. A non-magnetic toner according to claim 1, wherein the low-molecular weight polymer is selected from the group comprising a polystyrene resin and a styrene-n-butyl-acrylate copolymer resin.

* * * * *